US011118348B2

(12) United States Patent
Strickland

(10) Patent No.: US 11,118,348 B2
(45) Date of Patent: Sep. 14, 2021

(54) ALIGNMENT ASSEMBLY FOR PANELS

(71) Applicant: INVENT TO BUILD INC., Richmond Hill (CA)

(72) Inventor: Michael R. Strickland, Richmond Hill (CA)

(73) Assignee: INVENT TO BUILD INC., Richmond Hill (CA)

( * ) Notice: Subject to any disclaimer, the term of this patent is extended or adjusted under 35 U.S.C. 154(b) by 0 days.

(21) Appl. No.: 16/752,351

(22) Filed: Jan. 24, 2020

(65) Prior Publication Data

US 2020/0240141 A1 Jul. 30, 2020

Related U.S. Application Data

(60) Provisional application No. 62/796,466, filed on Jan. 24, 2019.

(51) Int. Cl.

| | |
|---|---|
| ***E04B 2/88*** | (2006.01) |
| ***E04C 2/38*** | (2006.01) |
| ***E04B 2/00*** | (2006.01) |
| ***E04C 2/00*** | (2006.01) |

(52) U.S. Cl.

CPC ..... *E04B 2/88* (2013.01); *E04C 2/384* (2013.01); *E04C 2/46* (2013.01); *E04C 2002/002* (2013.01)

(58) Field of Classification Search

CPC ... E04B 2/88; E04B 2/90; E04C 2/384; E04C 2/46; E04C 2002/002

See application file for complete search history.

(56) References Cited

U.S. PATENT DOCUMENTS 3,824,750 A * 7/1974 Antoniou ..... E04B 1/34815 52/79.13
4,435,927 A * 3/1984 Umezu ..... E04B 1/3483 52/235
4,893,445 A * 1/1990 Hefer ..... E04C 2/08 52/234

(Continued)

FOREIGN PATENT DOCUMENTS

CN 107675895 A * 2/2018 ..... E04B 1/3483
FR 2885376 A1 * 11/2006 ..... E04F 13/0846
FR 2934000 A1 * 1/2010 ..... E04G 21/3233

OTHER PUBLICATIONS

International Search Report and Written Opinion for PCT/CA2020/050089 (9 pages). (Year: 2020).*

*Primary Examiner* — Rodney Mintz
(74) *Attorney, Agent, or Firm* — Hill & Schumacher

(57) ABSTRACT

A panel system configured to be attached to vertically adjacent panels systems includes a frame having a top track, a bottom track and a plurality of generally vertical members extending between the top track and the bottom track. The panel system also includes at least one exterior finish component operably attached to the frame; and a plurality of alignment assemblies operably attached to the frame. Each alignment assembly has a lower fixing plate having an alignment pin extending upwardly therefrom, the lower fixing plate being operably attached to the top track of the frame; and an upper alignment plate being operably attached to bottom track of the frame and having a hole formed therein, wherein the alignment pin of the lower fixing plate is configured to be received by the upper alignment plate attached to a vertically adjacent panel.

40 Claims, 26 Drawing Sheets

(56) References Cited

U.S. PATENT DOCUMENTS

| | | | | | |
|---|---|---|---|---|---|
| 5,063,718 | A * | 11/1991 | Nonis | E04B 2/90 | 52/235 |
| 5,067,300 | A * | 11/1991 | Takeda | E04B 2/90 | 52/745.1 |
| 5,396,742 | A * | 3/1995 | Romig | B65D 90/24 | 403/14 |
| 7,594,361 | B2 * | 9/2009 | Tragant Ruano | E04B 1/34823 | 220/1.5 |
| 8,365,473 | B2 * | 2/2013 | Bjerre | E04B 1/34823 | 52/79.9 |
| 9,212,481 | B2 * | 12/2015 | Stramandinoli | E04B 2/90 | |
| 2006/0196132 | A1 * | 9/2006 | Ruano | E04G 21/142 | 52/236.3 |
| 2011/0011011 | A1 * | 1/2011 | Bjerre | E04C 2/322 | 52/79.9 |
| 2015/0284950 | A1 * | 10/2015 | Stramandinoli | E04B 2/90 | 52/235 |

* cited by examiner

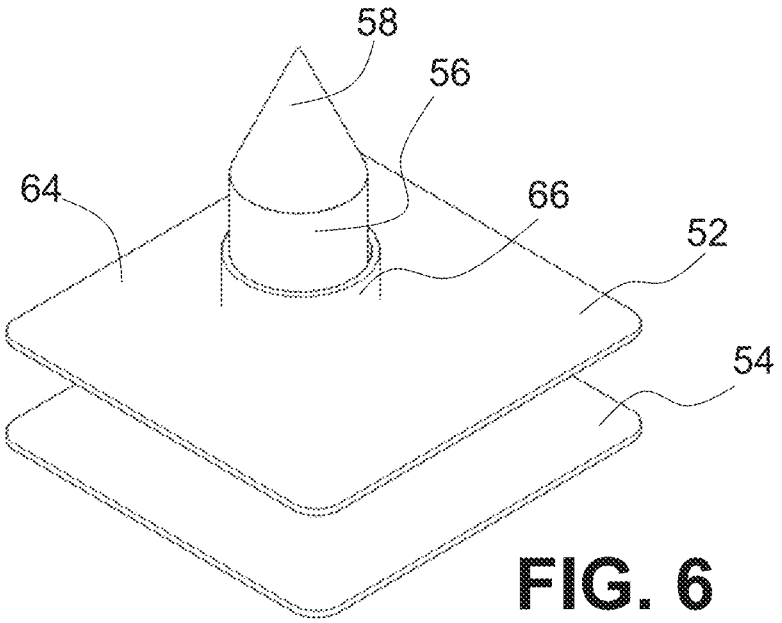
FIG. 6
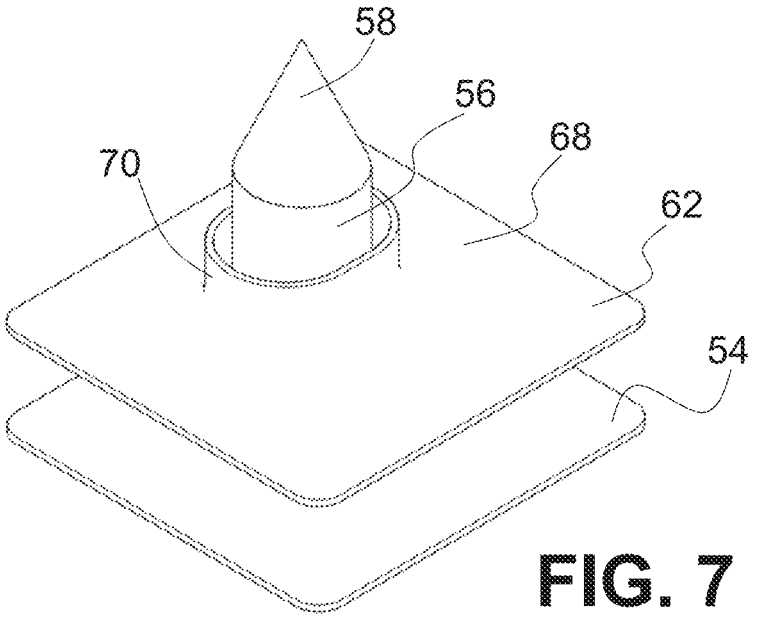
FIG. 7
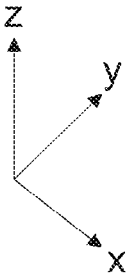

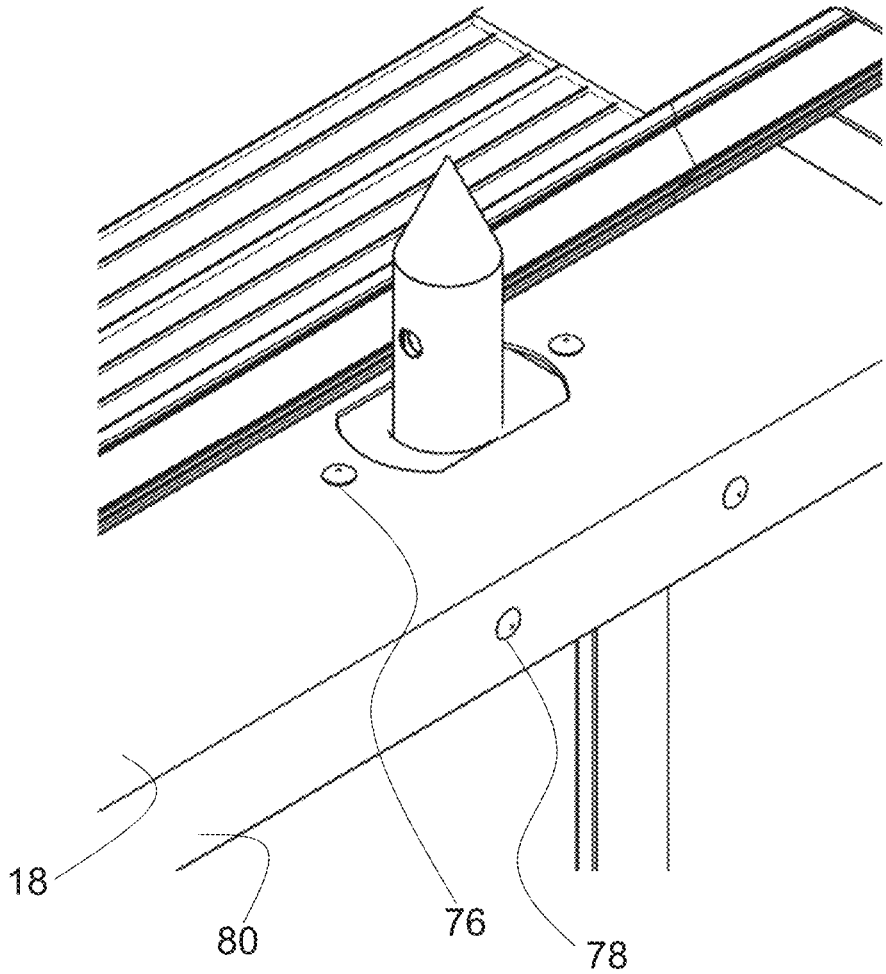
FIG. 14
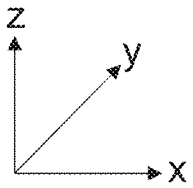

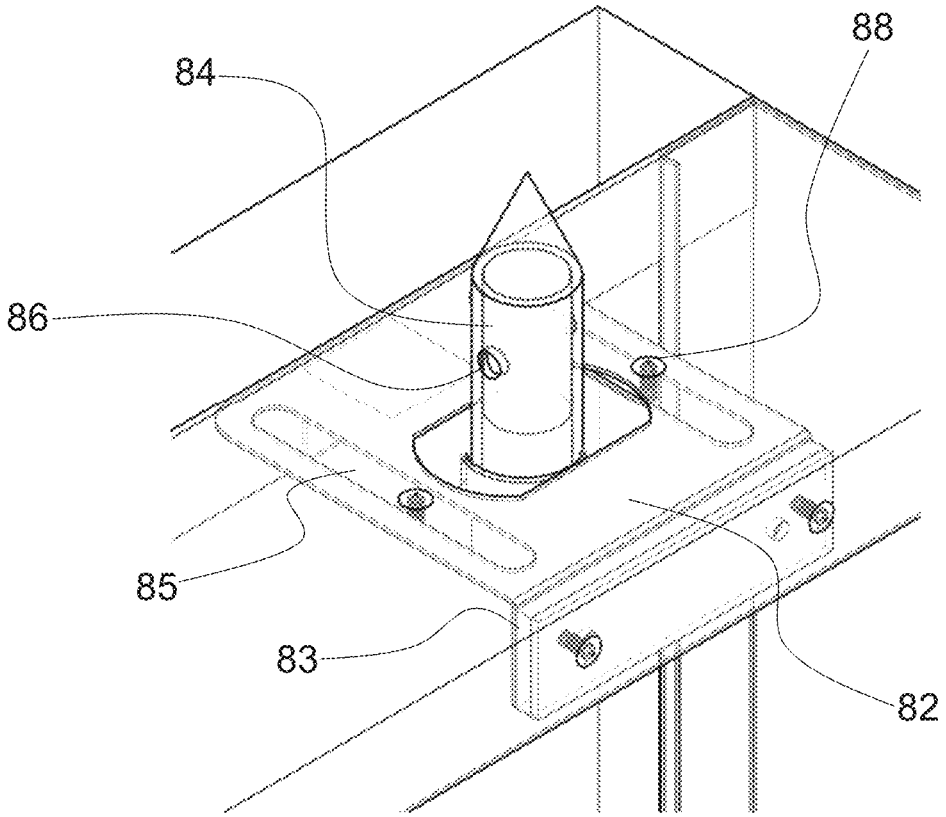
FIG. 15
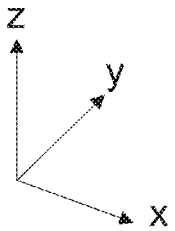

ALIGNMENT ASSEMBLY FOR PANELS

FIELD OF THE DISCLOSURE

This disclosure relates to panels such as curtain wall panels and in particular an alignment assembly for panels.

BACKGROUND

There are many Cold Formed Steel (CFS) systems that are being used for exterior curtain wall construction for buildings. One disadvantage of CFS systems is that they are not as dimensionally accurate as other framing system currently available in the market such as aluminium framed curtain wall. Therefore, alignment of the exterior finish (when the panels are prefinished) and sealing of the joints requires some complex or inefficient methods to be used. Not having a way to deal with the large tolerance issue has kept the CFS industry from moving up-market to more expensive finish systems wherein tighter tolerances are required and where higher margins exist. Some Cold Form Steel curtain wall fabrication is done by placing an aluminum curtainwall system around the perimeter to create more accuracy for the finish and seal systems, but this is very expensive. Some Cold Formed Steel fabricators live with the tolerance issues and align the panels as best possible by visual observation for plumbing and aligning the panels on site during or after erection. Often, the only option to seal unitized CFS joints is with caulking, in order to allow post-installation adjustment and to accommodate the large variances in tolerances.

In addition to the constructions challenges encountered with CFS systems there are also issues around wind loads. By way of example, in the USA 'The International Building Code' governs how buildings must be built. Wind speeds are used in conjunction with a number of other factors to calculate the pressures experienced on the exterior walls of buildings. All down the West coast wind speeds are 110 mph. On the East Coast windspeeds can vary dramatically, from Maine to Florida Wind speeds vary from 115 to 180 mph. Building designers must determine the Design Wind Pressures in order to design a building structure. In Canada wind loads are governed by regional and provincial code requirements.

Design wind pressures are determined on the basis of applying various factors to the basic wind pressure as per the applicable building code. It would be advantageous to provide an alignment assembly for panels that aids in the construction of a curtain wall. Further either in addition or alternatively it would be advantageous to provide an alignment assembly for panels for use in a curtain wall that takes into account the resulting loads experienced by wind.

SUMMARY

The present disclosure relates to a panel system which is configured to be attached to vertically adjacent panel systems. The panel system includes a frame, at least one exterior finish component and a plurality of alignment assemblies. The frame has a top track, a bottom track and a plurality of generally vertical members extending between the top track and the bottom track. The at least one exterior finish component is operably attached to the frame. The plurality of alignment assemblies are operably attached to the frame. Each alignment assembly has a lower fixing plate and an upper alignment plate. The lower fixing plate has an alignment pin extending upwardly therefrom. The lower fixing plate is operably attached to the top track of the frame.

The upper alignment plate is operably attached to bottom track of the frame. The upper alignment plate has a hole formed therein for receiving the alignment pin. The alignment pin of the lower fixing plate is configured to be received by an upper alignment plate attached to a vertically adjacent panel.

At least two of the alignment pins in the plurality of alignment assemblies may each have a hole therein configured to receive a rigging that is attachable to a hoist.

The alignment assembly may have an upper alignment plate with a rim portion extending upwardly from the hole and having a generally circular hollow pipe shape. Alternatively, the upper alignment plate of the alignment assembly may be an upper slotted alignment plate with a slotted rim portion extending upwardly from the hole and having a generally ovoid shape.

The lower fixing plate may further include opposing side lower lips and opposing end lower lips extending downwardly from edges thereof.

The upper alignment plate may further includes opposing side upper lips and opposing end upper lips extending upwardly from edges thereof.

The alignment assembly may include at least one pin saddle attached to one of the lower fixing plate and the upper alignment plate.

The pin saddle may includes an end arm extending generally vertically from one end of the lower fixing plate and the upper alignment plate and attached to one of the plurality of generally vertical members of the frame. The pin saddle may further include at least one side arm extending generally vertically from one side of one of the lower fixing plate and the upper alignment plate. The pin saddle may include two opposed side arms extending generally vertically from each side of one of the lower fixing plate and the upper alignment plate. The pin saddle may further include a second end arm spaced from the end arm and extending generally vertically from one end of the lower fixing plate and the upper alignment plate and whereby the end arm, the second end arm and the two opposed side arms form a box. The pin saddle may further include an alignment pin stability plate having a cut out portion for receiving the alignment pin. The pin saddle may further include an upper fixing plate having a hole formed therein for receiving the alignment pin.

The alignment assembly may further include a second pin saddle and the at least one pin saddle is an upper pin saddle attached to the upper alignment plate and the second pin saddle is a lower pin saddle attached to the lower fixing plate.

The alignment assembly may include a pin saddle and a second pin saddle attached to the frame.

The lower fixing plate may include a flange extending downwardly from one side thereof configured to be attachable to a flange of the top track. The flange of the lower fixing plate may be attached to the flange of the top track with screws. An angle tab may be attachable to the lower fixing plate.

The lower fixing plate may include two slots on either side of the alignment pin for receiving screws and the screws are for attaching the lower fixing plate to the top track of the frame of the panel.

The alignment pin in each alignment assembly may include a conical cap. The conical cap may be a removable conical cap.

The panel system may include a plurality of panels systems.

Further features will be described or will become apparent in the course of the following detailed description.

BRIEF DESCRIPTION OF THE DRAWINGS

The embodiments will now be described by way of example only, with reference to the accompanying drawings, in which:

FIG. 6 is a perspective view of the alignment assembly of FIG. 5;

FIG. 7 is a perspective view of an alignment assembly similar to that shown in FIG. 5 but showing an alternate embodiment of the upper alignment plate;

FIG. 14 is an enlarged view of the lower alignment plate of the alignment assembly of FIG. 10;

FIG. 15 is an enlarged view of the lower alignment plate of the alignment assembly as shown in FIG. 14 but with the bottom track being transparent;

DETAILED DESCRIPTION

Figure 1:
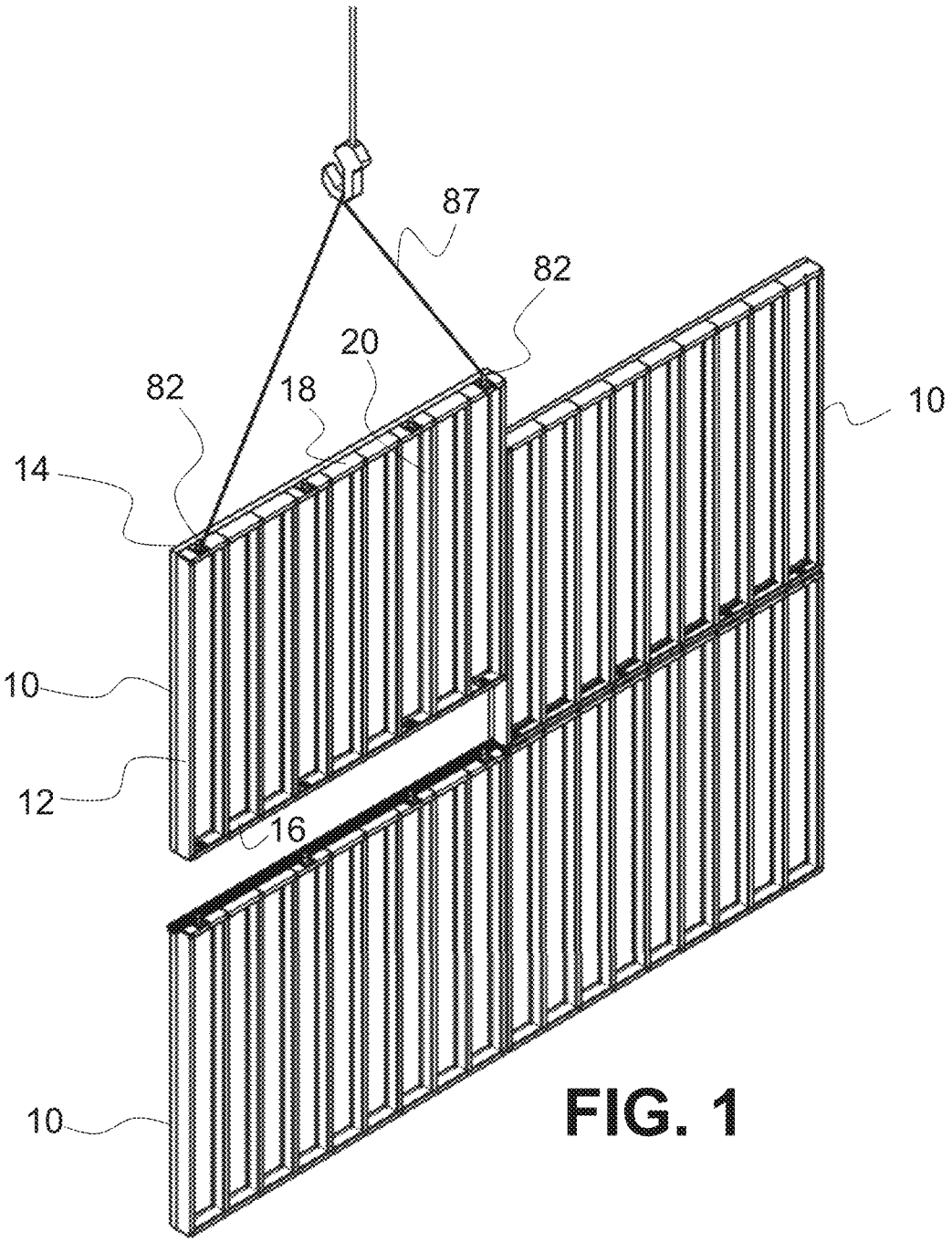
FIG. 1 is a perspective view of a panel being lowered into place.
Figure 2:
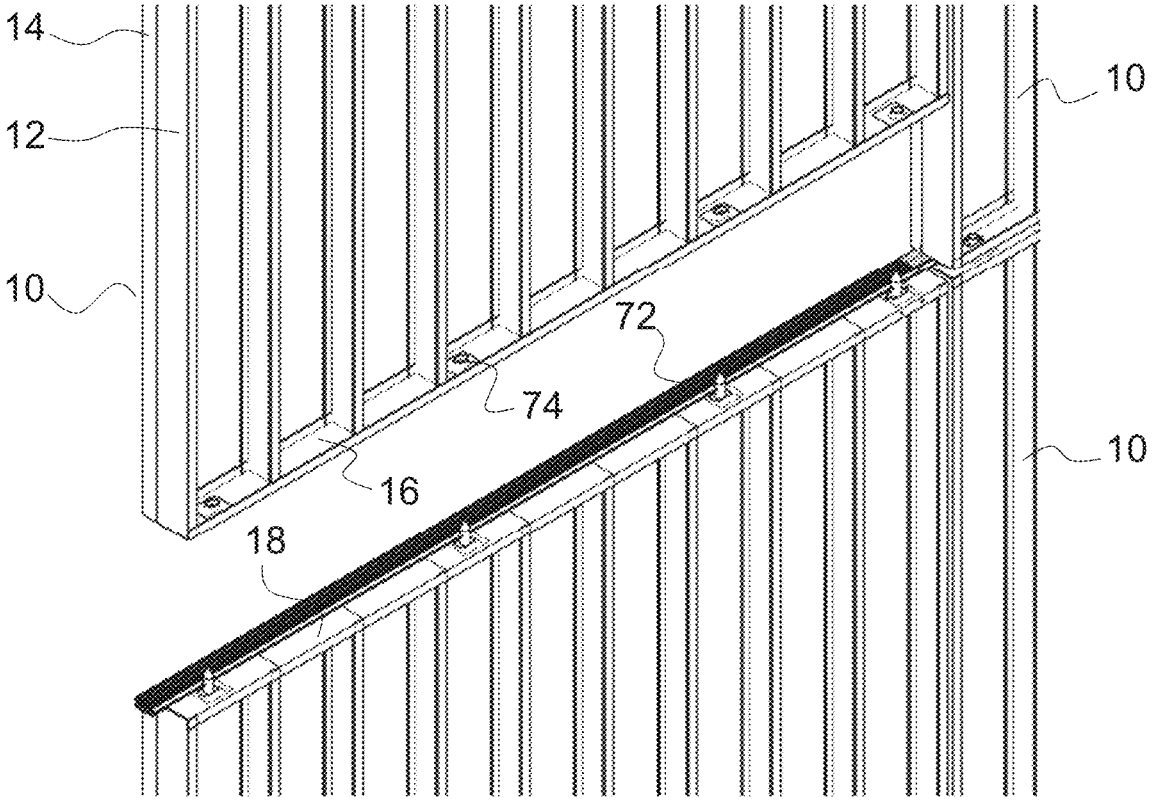
FIG. 2 is an enlarged perspective view of the panel of FIG. 1 showing the alignment pins.
Figure 3A:
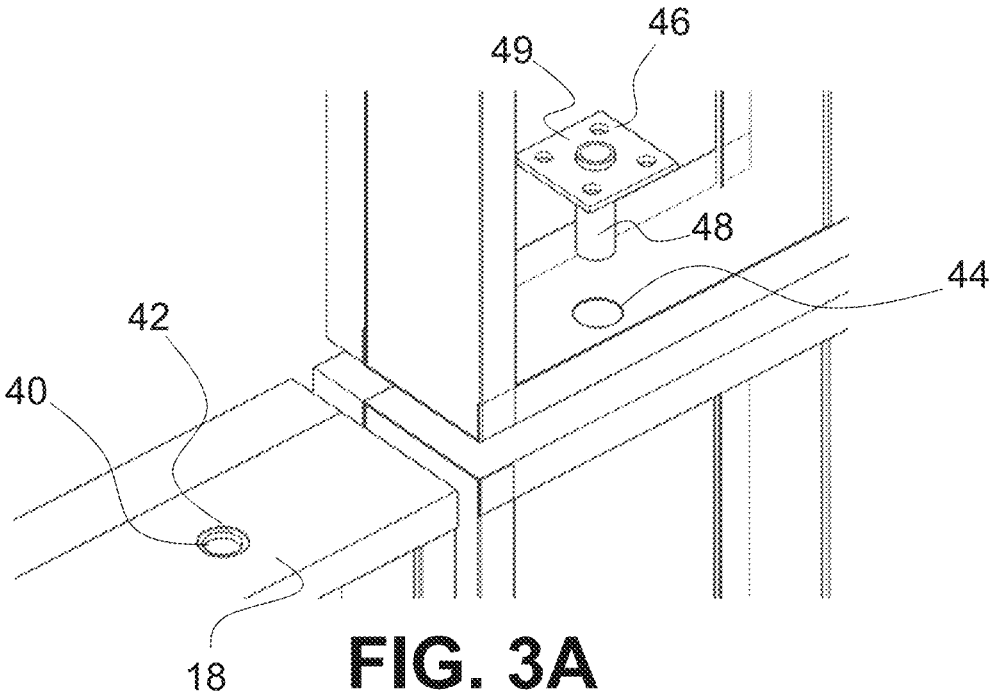
FIG. 3A (PRIOR ART)
FIG. 3A is a perspective view of a prior art connection between panels using a plate with an alignment pin welded thereto being positioned to be inserted into panels.
Figure 3B:
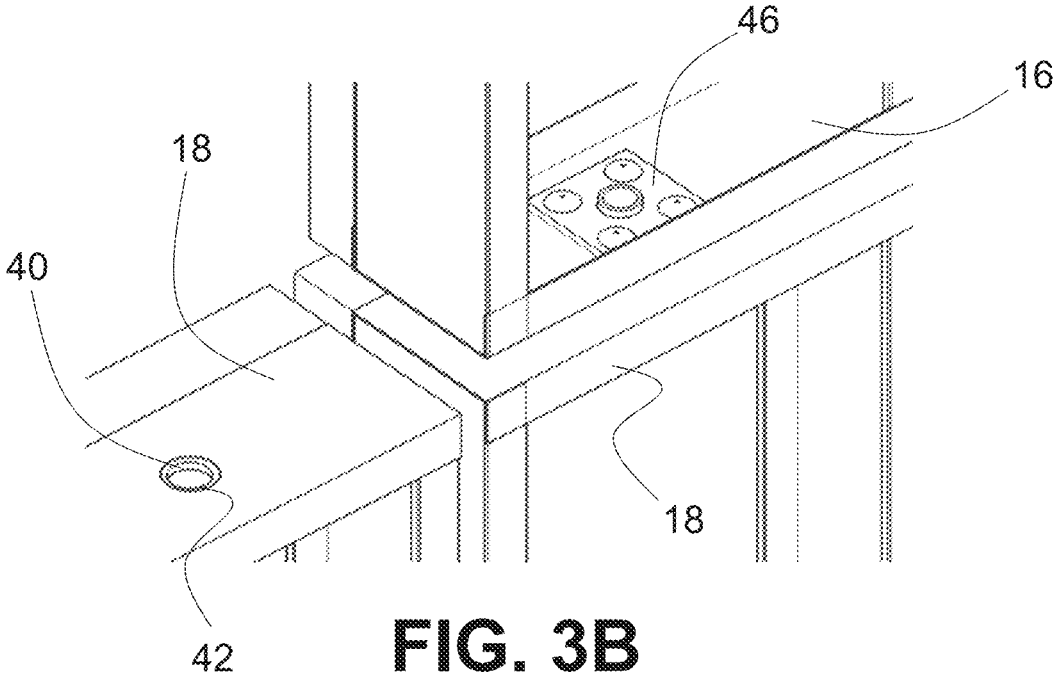
FIG. 3B (PRIOR ART)
FIG. 3B is a perspective view of a prior art connection similar to that shown in FIG. 3A but showing the plate after the pin has been inserted.

Referring to the drawings, FIG. 1 is a perspective view of a panel 10 being lowered into place and FIG. 2 is an enlarged perspective view of the panel of FIG. 1 showing the alignment pins. A typical panel 10 includes a frame 12 and one or more exterior finish components 14 operably attached to the frame 12. The frame 12 includes bottom track 16, a top track 18 and a plurality of generally vertical members 20 extending between the bottom track 16 and the top track 18. Typically, the frame 12 is constructed from cold rolled steel members. The panel 10 shown herein includes an alignment assembly 50 (see FIG. 5), which provides a number of advantages over the prior art.

The alignment assembly 50 has been developed for use with Cold Formed Steel (CFS) framing. It provides a way to deal with the inherent inaccuracies of most cold rolled steel frames 12 and it provides a system for aligning finished panels accurately in final position when placed one above another. The alignment assembly 50 can be installed offsite thus reducing the onsite labor costs. This alignment assembly has particular usefulness in that prefinished unitized CFS curtain wall panels can be aligned passively when installing panels by referencing the finished surfaces in the plant with alignment devices provided in this system.

The alignment assembly 50 is an improvement over the prior art shown in FIGS. 3A and 3B and FIGS. 4A and 4B. In the prior art a top track 18 has a thick plate welded 40 to the underside of the top track 18, the edge of which can be seen through a top track alignment hole 42. Similarly, bottom track 16 has a bottom track alignment hole 42 therein. Typically, the bottom track 16 and top track 18 will have a plurality of bottom track alignment holes 42 and a top track alignment holes 44. The hole 42 is dimensioned to fit peg insert 48. Peg insert 46 includes a peg 48 welded to a plate 49. In use the panels are lowered into place and the people on site to align the exterior finished panels by adjusting the panels in place after erection so the joints have optimum spacing and the finished panels are aligned. Once the finished panels are in place the peg insert 46 is pushed into plate 40 and then it is fastened with screws going downward into track 16. It will be appreciated by those skilled in the art that these screws will be located below the panels bottom track and may interfere with the intended panel movements, this method of panel alignment can be a more time consuming means of aligning panels versus a chicken head system.

Figure 4A:
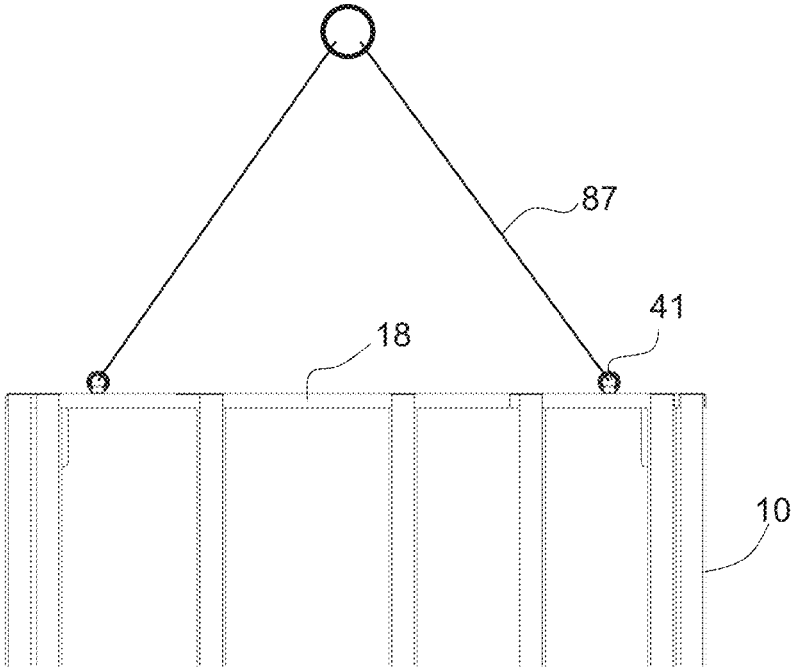
FIG. 4A (PRIOR ART)
FIG. 4A is a front view of a prior art hoisting arrangement.
Figure 4B:
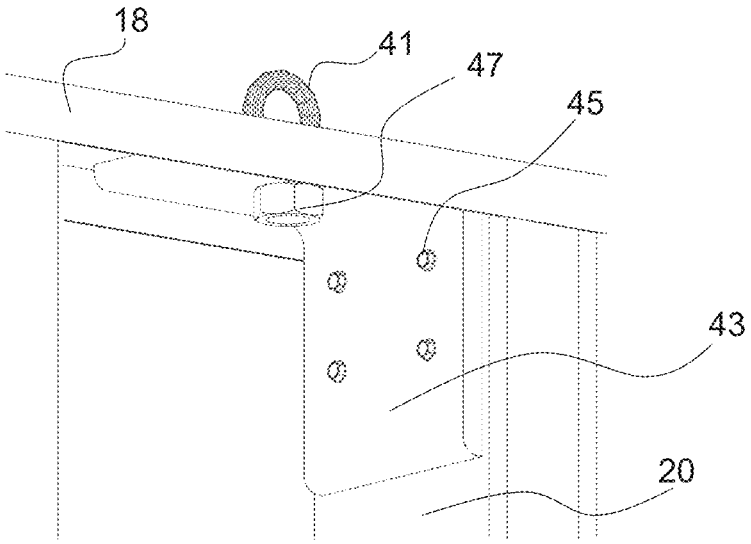
FIG. 4B (PRIOR ART)
FIG. 4B is a perspective view of a prior art eye bolts used in the hoisting arrangement of FIG. 4A.

In the prior art eye bolts 41 are attached to the top track 18 as shown in FIGS. 4A and 4B. A standard angle 43 is bolted to a vertical member 20 typically with self-tap screws 45. Typically, a hole is hollow drilled into angle 43 and a nut 47 is welded to the underside thereof. The eye bolt is attached to the nut 47. The eye bolts 41 are provided so that rigging 87 can be attached thereto and the panel may be hoisted into position.

Figure 5:
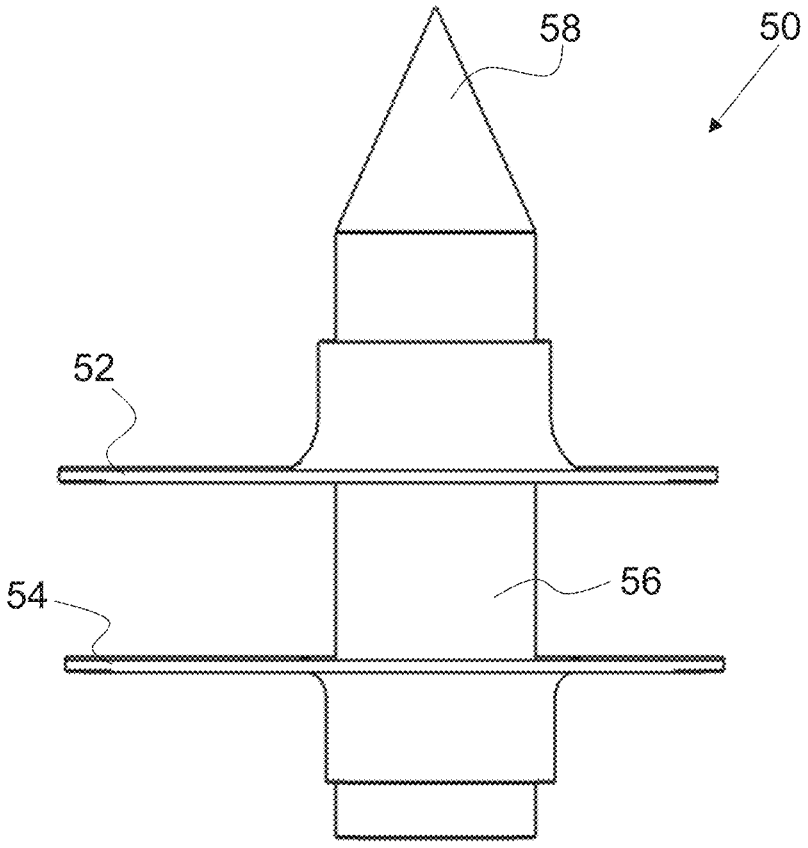
FIG. 5 is an enlarged side view showing an alignment assembly including an upper alignment plate and a lower alignment plate having a pin attached thereto.
Figure 8:
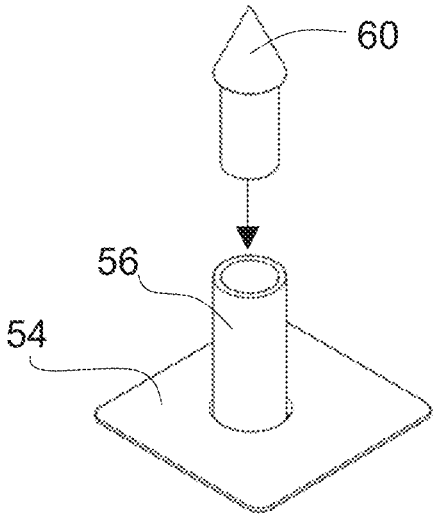
FIG. 8 is a perspective view of an alternate embodiment of the lower alignment plate of FIG. 5 showing a removable pin head.

Referring to FIGS. 5 and 6, the alignment assembly 50 shown herein provides a system that has a number of advantages over the prior art and specifically the prior art system shown in FIGS. 3 and 4. The alignment assembly 50 includes an upper alignment plate 52 and a lower fixing plate 54. The lower fixing plate 54 has an alignment pin 56 attached thereto and extending upwardly therefrom. In one embodiment the upper alignment plate 52, the lower fixing plate 54 and the alignment pin 56 are made from steel and the alignment pin 56 is welded to the lower fixing plate 54. The alignment pin 56 has a conical cap 58. The conical cap may be a removable conical cap 60 as shown in FIG. 8 and all other features of the lower fixing plate 54 are the same. In the embodiment with the removable conical cap 60 the conical caps 60 may be reused in other locations once the vertically adjacent panels are in place.

An alternate version of the upper alignment plate 62 is shown in FIG. 7. Upper slotted alignment plate 62 is similar to that shown in FIGS. 5 and 6 but the hole is shaped differently. Upper alignment plate 52, of FIG. 6 includes a plate portion 64 and a rim portion 66 which extends upwardly from the plate portion 64. Rim portion 66 has a generally circular hollow pipe shape. Rim portion 66 is dimensioned to receive alignment pin 56 such that there is minimal tolerance therebetween. Upper slotted alignment plate 62, of FIG. 7 includes a slotted plate portion 68 and slotted rim portion 70 which extends upwardly from the slotted plate portion 68. The slotted rim portion 70 has a generally elongate ovoid shape or is generally a hockey rink shaped slot that is generally rectangular with curved ends. Rim portion 70 is dimensioned to receive alignment pin 56 such that there are minimal tolerances in an x direction and more generous tolerances in the y direction. In use the y direction is parallel to the front finished face of the panel and the x direction is with reference to the finished sides of the panel.

Figure 10:
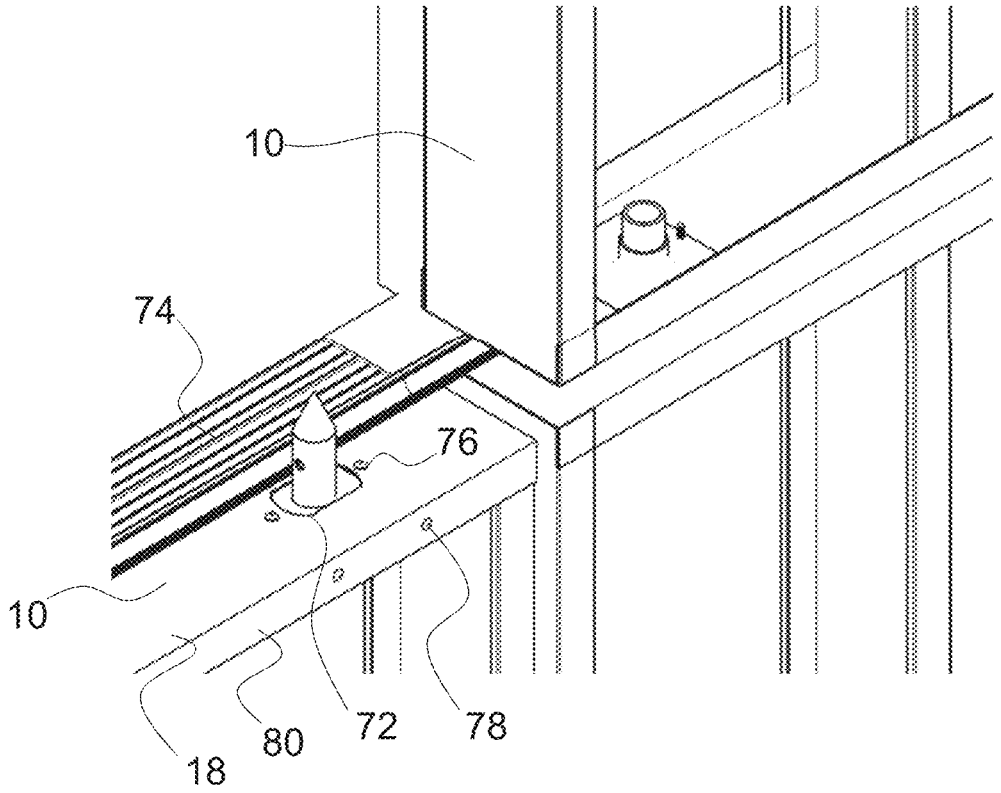
FIG. 10 is a perspective view of the alignment assembly in situ showing a four-way joint with three panels in place.

As described above the panel 10 includes a frame 12 and one or more exterior finish components 14. The frame 12 includes bottom track 16, a top track 18 and a plurality of generally vertical members 20. The top track 18 has a plurality of spaced apart holes 72 formed therein. The holes 72 are positioned so that a horizontal seal 74 along the top of the panel 10 does not cover the holes 72, as best seen in FIG. 10. The holes 72 are generally an elongate ovoid shape. The holes 72 are spaced apart along the top track and are a predetermined distance from the front face of the panel, as can be seen in FIG. 2. Similarly, the bottom track 16 has a plurality of spaced apart holes formed therein. Holes are a predetermined distance from the front face of the panel. Preferably holes 72 in the top track and holes in the bottom track are punched into the top track 18 and bottom track 16 respectively when they are rolled formed or they can be placed off line using a punch.

Figure 9:
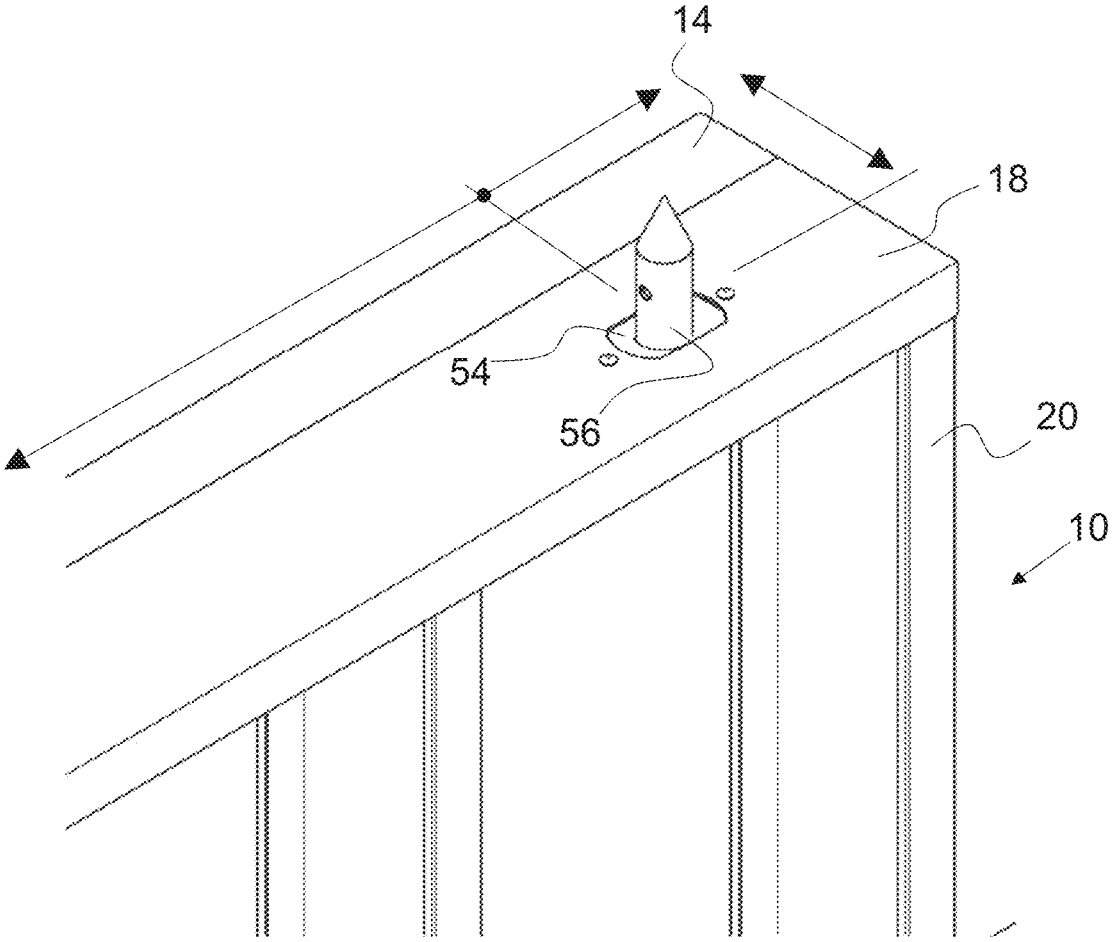
FIG. 9 is a perspective view of the lower alignment plate of FIG. 5 attached to a panel.
Figure 11:
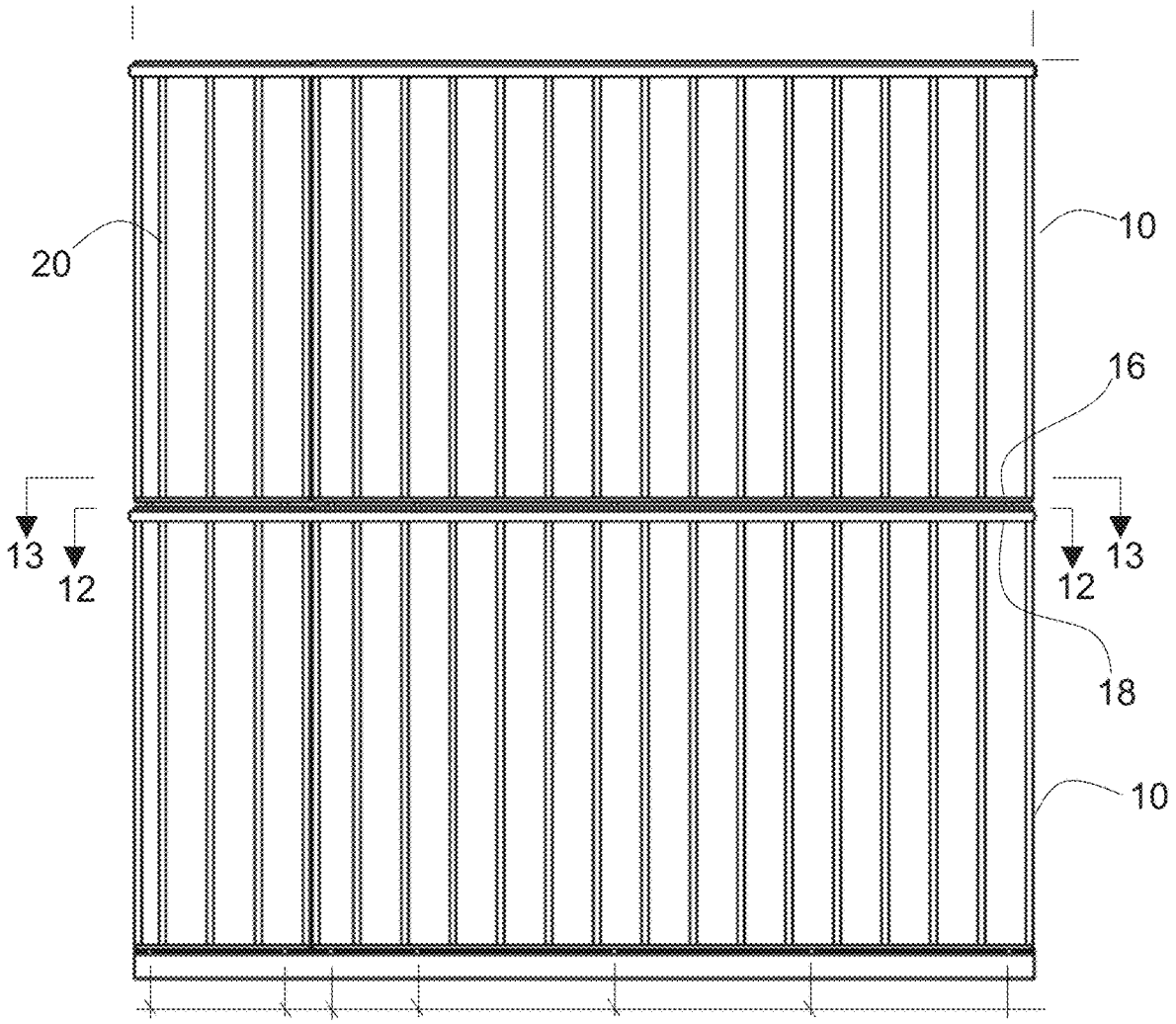
FIG. 11 is front view of an upper and a lower panel.
Figure 12:
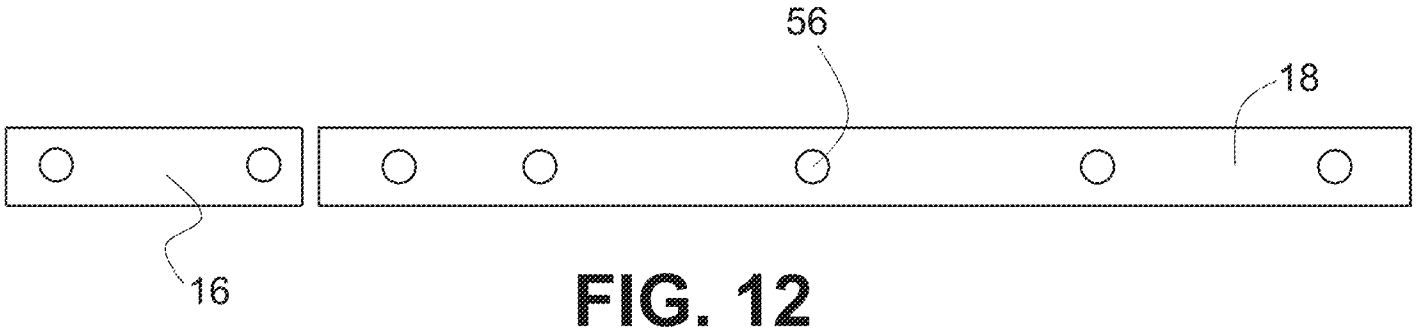
FIG. 12 is a sectional view of the top track of the frame of the lower panel taken along line 12-12 of FIG. 11 showing the positions of the fixing pins.
Figure 13:
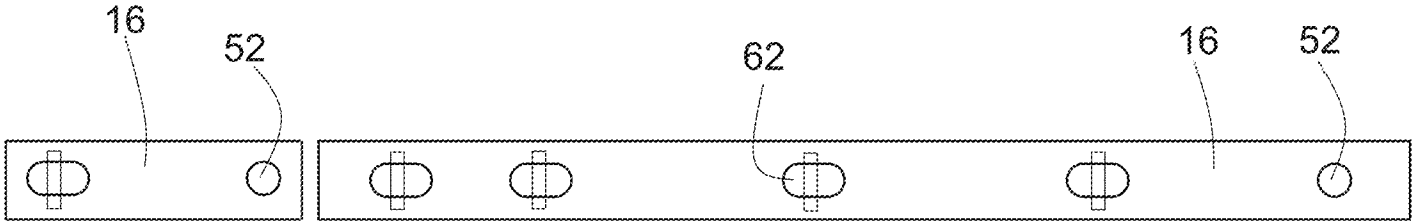
FIG. 13 is a sectional view of the lower track of the frame of the upper panel taken along line 13-13 of FIG. 11 showing the positions of alignment plates and alternate alignment plates.

The positioning on the alignment assembly of upper alignment plates 52 and upper slotted alignment plates 62 and the lower fixing plates are shown in FIGS. 11 to 13. The alignment pin 56 of the lower fixing plate 54 is positioned a predetermined distance from the finished sides of panel 10 and from the finished front face of the panel as shown in FIG. 9. The distance between the remaining fixing plates 54 and alignment pins 56 are positioned at predetermined distances along the top track 18 as shown in FIG. 12. The bottom track 16 has an upper alignment plate 52 attached at a predetermined distance from the finished sides of the panel and the finished front face of the panel. A plurality of upper slotted alignment plates 62 are spaced at predetermined distances from the upper alignment plate 52 as shown in FIG. 13. In use the upper alignment plate is positioned in registration with the alignment pin 56 positioned proximate to the finished front face of the panel. Since the remaining plates are upper slotted alignment plates 62 the slotted rim portion allows for some variance in tolerance between the adjacent pins in the y direction, thus allowing for some tolerances in the manufacturing that are associated with CFS.

Figure 16:
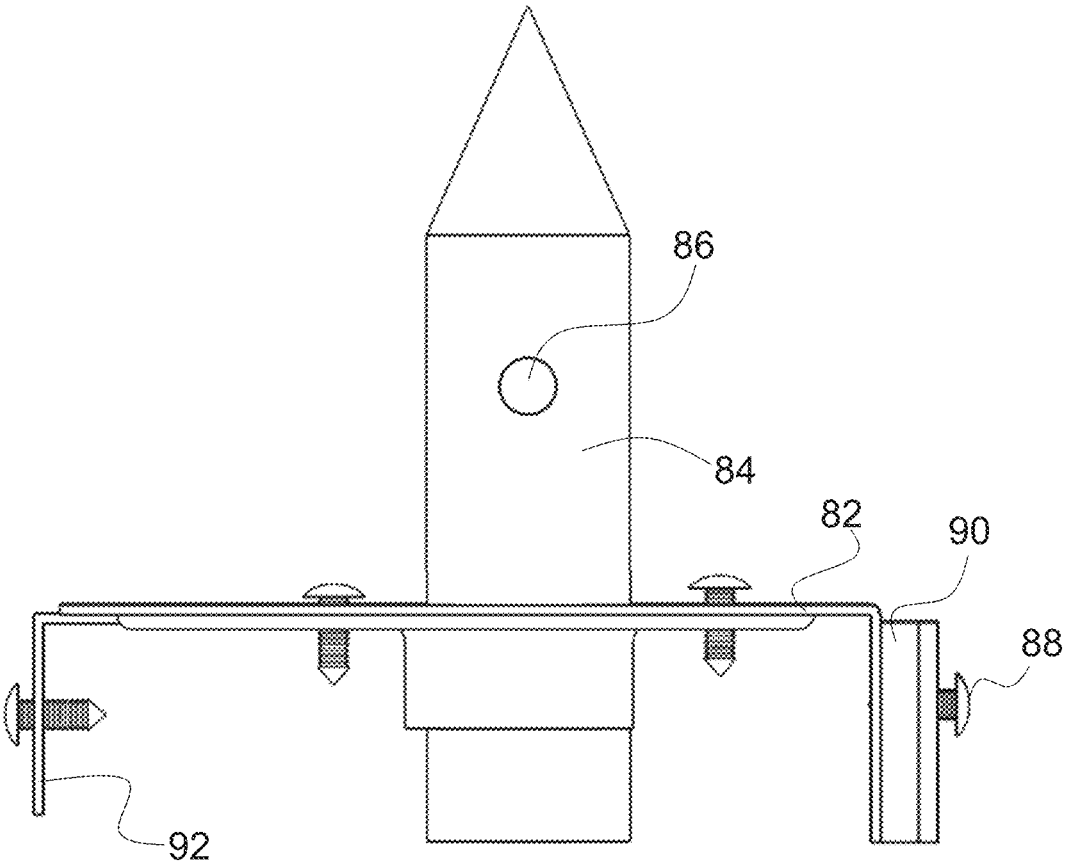
FIG. 16 is a side view of the lower alignment plate of the alignment assembly of FIG. 10.

The alignment assembly 50 may also be used as a lifting device as shown in FIG. 1. As best seen in FIGS. 14-16 an alternate lifting lower fixing plate 82 includes an alignment pin 84 with a hole 86 formed therein. The hole 86 is provided so that rigging 87 (shown in FIG. 1) can be attached thereto. In use typically the opposing ends of panel will have lifting lower fixing plates 82 so that they can be easily attached to rigging and thereafter a hoist. It will be appreciated by those skilled in the art that if needed multiple lifting lower fixing plates 82 may be used along the panel 10 to provide multiple lifting points.

Lifting lower fixing plate 82 is similar to lower lifting plate 54 described above. Lifting lower fixing plate 82 includes an alignment pin 84 with a hole 86 formed therein. Lifting lower fixing plate 82 has a flange 83 extending downwardly from one side of the plate so that it can be attached to the flange of the top track 18 to provide a lever arm against torsion when the panel is being lifted. The panel is typically laying flat in the shop when the lower fixing plate 82 is being installed. Because the panel is finished on its top side, one has to reach underneath the panel in a blind fashion, so tab 92 is installed prior to the finish to hold plate 82 in place while plate 92 is being positioned and fastened. Tab 92 holds the lower plate in place to allow movement of the lower plate 82 and pin 84 within the holes 72 along the x and y axis. Shims 90 may be used if needed to fill the faying area between the flange 83 and the flange of the top track 18. In this embodiment screw holes 76 are formed in the top track 18 during manufacture thereof. As shown in FIGS. 10, 15 and 16, screw holes 76 are positioned on either side and proximate to holes 72 along the y axis. Holes 78 may also be formed in the flange 80 of the top track 18.

In the embodiment shown in FIG. 16 an angle tab 92 is fastened to the flange of top track prior to installing finish. This angle tab 92 serves as a positioning device when the panel 10 is laying finished side up and the lifting lower fixing plate 82 is being installed in a blind fashion.

Figure 17:
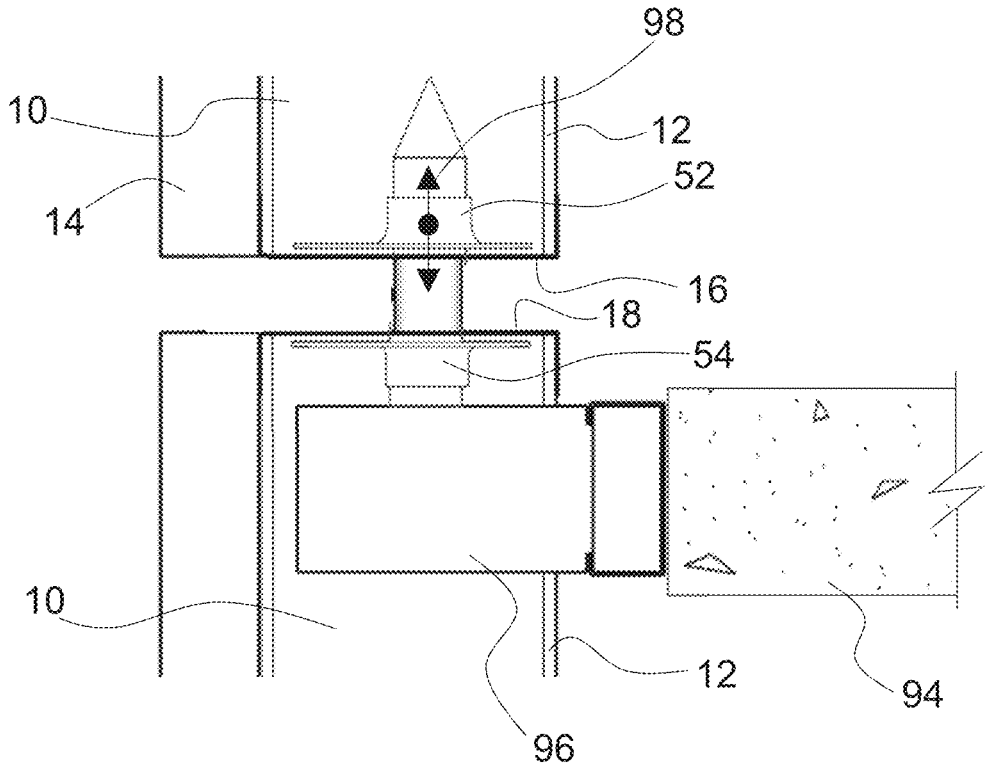
FIG. 17 is a sectional view of the alignment assembly.

Referring to FIG. 17 the alignment assembly shown herein is designed to provide for some relative vertical movement of the panels. As shown in the arrows 98 it allows for some up and down movement of the panels 10. The panels 10 are attached to a curtain wall support 96 which is attached to the floor 94. The floor is typically a concrete floor slab. The lower alignment plate 54 is attached to the top track 18 of the steel frame 12 of the wall panel 10. An exterior finish system 14 is attached to the steel frame 12. The upper alignment plate 52 is attached to the bottom track 16 of the steel frame 12 of the panel 10.

The alignment assembly 50 shown herein describes the fixing plates that may be installed whilst the panels are laying flat, finished side up, in most Cold Formed Steel panel production facilities. With this new Cold Formed Steel alignment assembly, exterior curtain wall panels can be erected much quicker and with much more accuracy. The inherent accuracy also allows the fabricator to supply a much more reliable and robust panel joint seal system.

Figure 18:
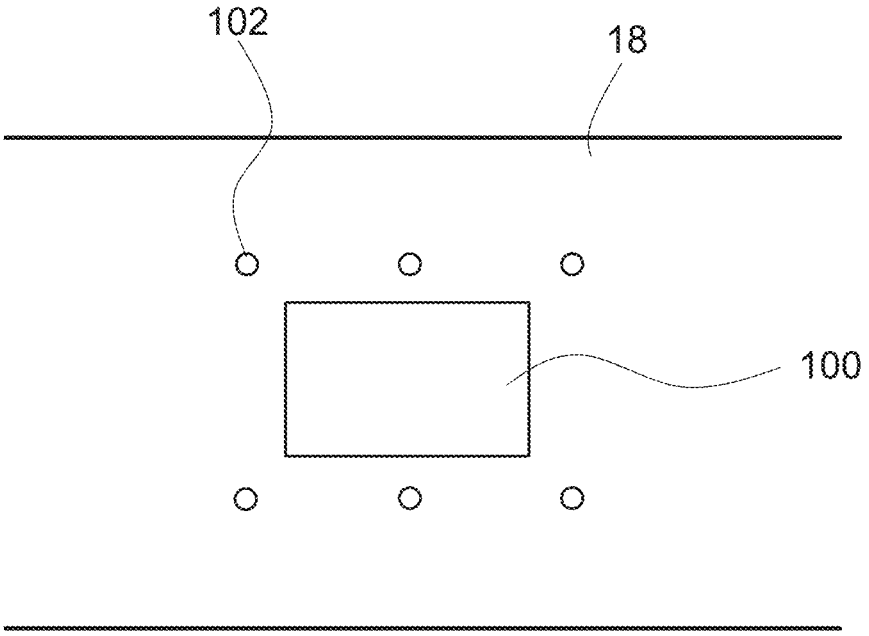
FIG. 18; is an enlarged top view of the pre-punched holes in the track showing pre-punched screw holes.

Referring to FIG. 18, preferably, the top track 18 has a track hole 100 pre-punched therein. Similarly, a plurality of screw holes 102 are pre-punched in the top track 18. Track hole 100 is sized to accommodate in/out and left/right alignment of a lower fixing plate (not shown). Similarly, a pre-punched track hole 100 and pre-punched screw holes 102 are provided in bottom track 16 and the track hole 100 is sized to accommodate an upper alignment plate. The track hole 100 is of sufficient size to allow adjustment of the alternate embodiments of plates of the alignment assemblies described herein.

Figure 19:
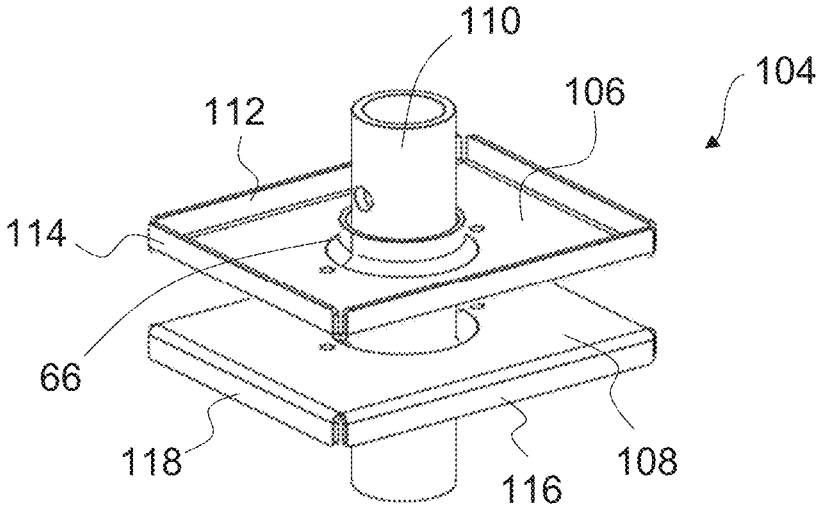
FIG. 19 is a perspective view of an alternate embodiment of an alignment assembly similar to that shown in FIG. 6 but showing a lip around the plate portions.

Referring to FIG. 19 another alternate alignment assembly is shown generally at 104. Alignment assembly 104 includes an upper alignment plate 106 and a lower fixing plate 108. The lower fixing plate 108 has an alignment pin 110 attached thereto and extending upwardly therefrom. In one embodiment the upper alignment plate 106, the lower fixing plate 108 and the alignment pin 110 are made from steel and the alignment pin 110 is welded to the lower fixing plate 108. The upper alignment plate 106 has opposing side upper lips 112 and upper end lips 114. The lower fixing plate 108 has opposing side lower lips 116 and lower end lips 118. Alternate alignment 104 has a rim portion 66 that has a generally circular hollow pipe shape as described above.

Figure 20:
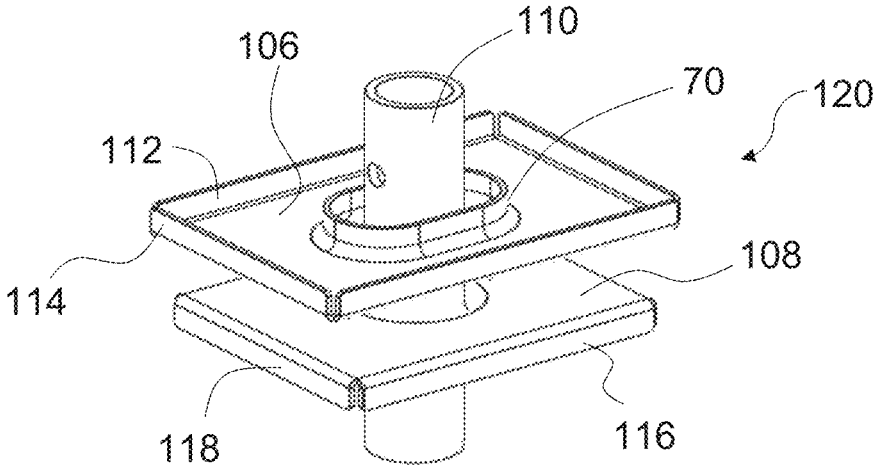
FIG. 20 is a perspective view of an alignment assembly similar to that shown in FIG. 19 but showing an alternate embodiment of the upper alignment plate.
Figure 21:
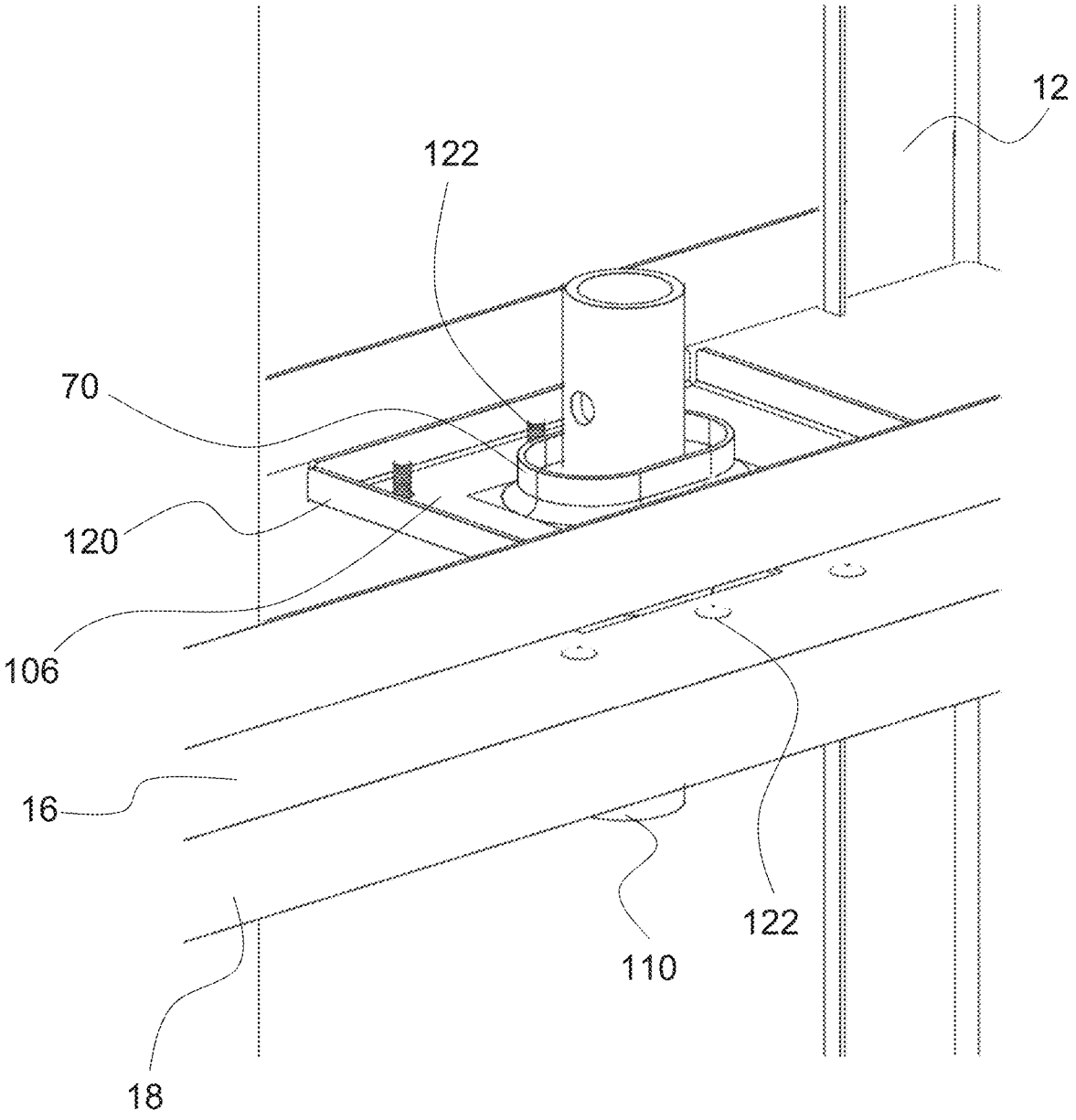
FIG. 21 is a perspective view of the alignment assembly of FIG. 20 in situ.

Another alternate alignment assembly is shown generally at 120 in FIG. 20. Alignment assembly 120 is the same as discussed in regard to alignment assembly 104 but with a slotted rim portion 70 that is generally an elongate ovoid shape rather than rim 66. FIG. 21 shows alignment assembly 120 in situ where upper fixing plate 106 is attached to bottom track 16. Fasteners 122 are used to attach alignment assembly 120 to the steel frame 12. Fasteners 122 attached to the bottom track 16 extend upwardly into the track and fasteners 122 attached to the top track 18 extend downwardly into the track as shown in FIG. 21. Pre-punched hole 100 and pre-punched screw holes 102 facilitate the assembly of the panel system. The fasteners 122 attached as shown in FIG. 21 have a very low profile from the outside of the frame 12. In contrast in the prior art shown in FIGS. 4B and 4B, the fasteners of the peg insert 46 and the angle 43 would extend into the gap between vertically adjacent panels 12 causing some restriction in the movement of the panels relative to each other.

Figure 22:
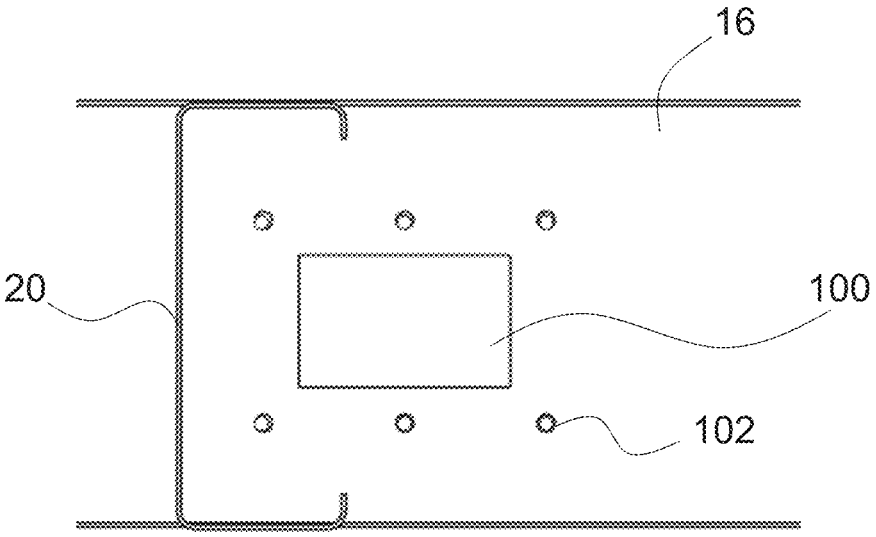
FIG. 22 is a top view of a portion of a bottom track of a frame and showing the pre-punched hole of FIG. 18.
Figure 23:
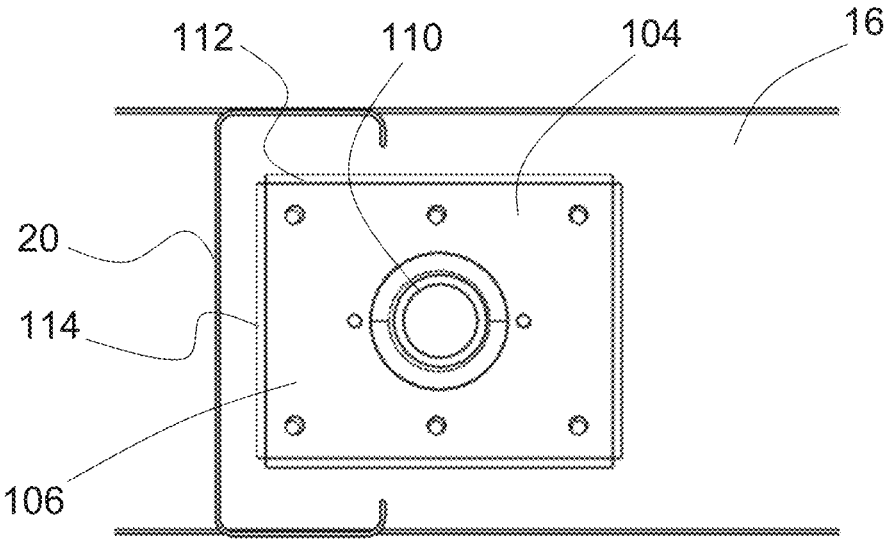
FIG. 23 is a top view of a bottom track of a frame similar to that shown in FIG. 22 but also showing the top alignment plate of FIG. 19 attached thereto.

Typically, pre-punched hole 100 will be located proximate to a vertical member 20. The example shown in FIG. 22 is a top view of a portion of a bottom track 16. The pre-punched hole 100 facilitates the positioning and attachment of an upper alignment plate of an alignment assembly. In the embodiment shown herein is the upper alignment plate 106 of alignment assembly 104. However, it will be appreciated by those skilled in the art the configuration would be similar for any of the alignment assemblies shown herein. Further it will be appreciated that while this is shown for a bottom track the configuration is similar for a top track. The upper alignment plate and the lower fixing plate of the alignment assemblies each serve to stiffen the track because of the addition of a plate. As can be appreciated by one skilled in the art locating the plates in close proximity to the stud as shown in FIG. 23 provides abundant resistance to overturning of the track when wind loads are taking place.

The alignment assembly shown herein may also include a pin saddle. The pin saddle may have a number of different configurations as shown in FIGS. 24 to 29. The pin saddle may serve a number of different purposes. By way of example the pin saddle shown in FIG. 25 adds more structural stability to the typical panel 10 when being hoisted by virtue of being located proximate to the stud 20 and fastened to same. Further the pin saddle adds structural stability to the frame 12 in regard to wind loads.

Figure 24:
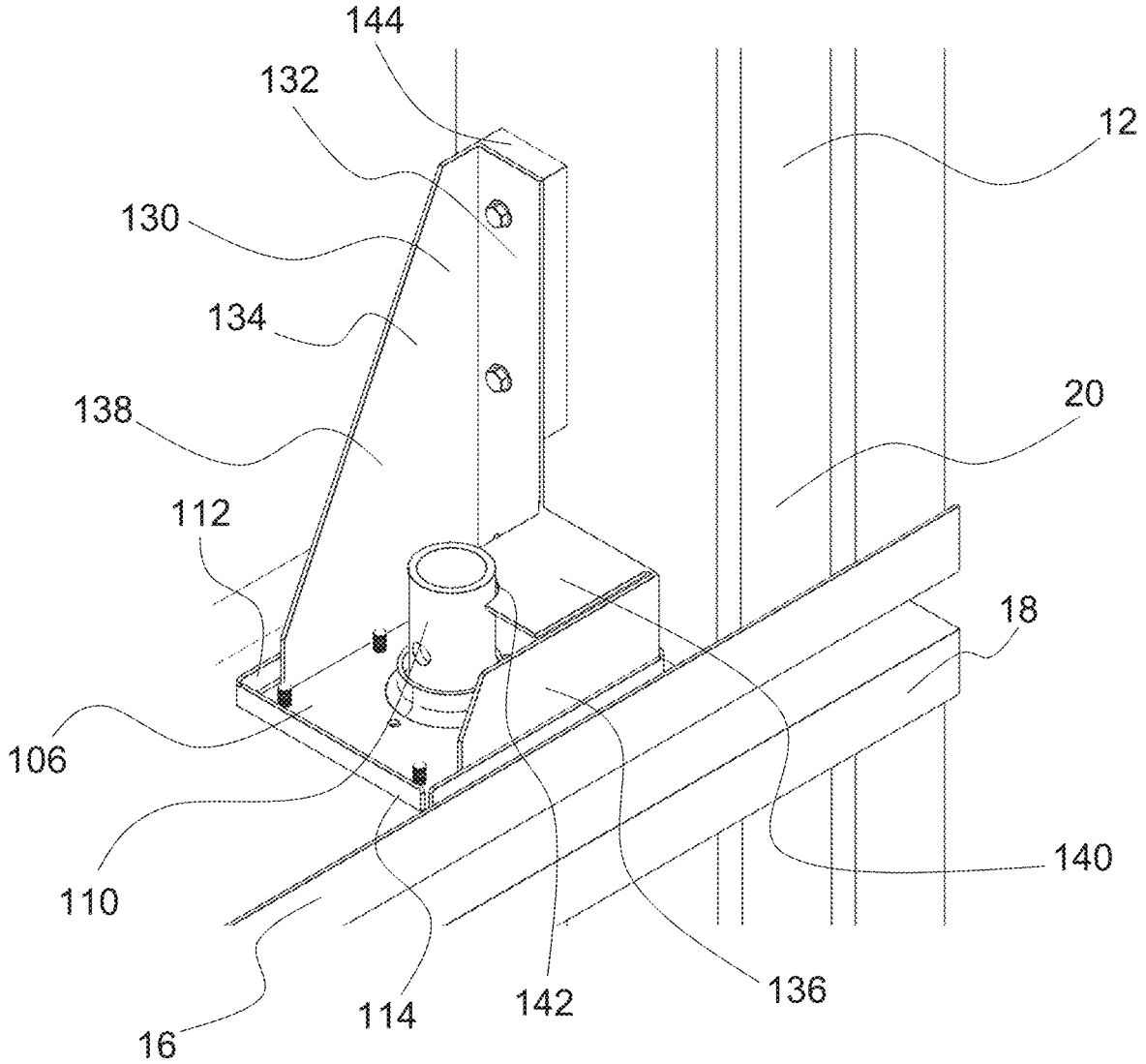
FIG. 24 is a perspective view of the alignment assembly in situ similar to that shown in FIG. 21 but also including a pin saddle.

An example of a pin saddle is shown generally at 130 in FIG. 24. Pin saddle 130 includes an end arm 132 extending generally vertically from one side of the upper alignment plate 106 and at least one side arm 134 extending generally vertically from one side thereof. In the embodiment shown herein there are two side arms 134, an inner side arm 136 and an outer side arm 138. In the embodiment shown herein the end arm 132 is generally L-shaped, the outer side arm 138 is generally triangular and the inner side arm 136 is generally rectangular with the height of the inner side arm 136 being substantially less than the height of the outer side arm 138. Saddle 130 includes an alignment pin stability plate 140 having a cut out portion 142 for receiving the alignment pin 110. The alignment pin stability plate 140 is attached to the end arm 132 and the inner side arm 136. Preferably the saddle 130 is welded to the lower fixing plate 106. Arm 132 acts as a torsion arm and is attached to a generally vertical member 20 of the frame 12. A shim 144 may be used between the arm 132 and vertical member 20.

Figure 25:
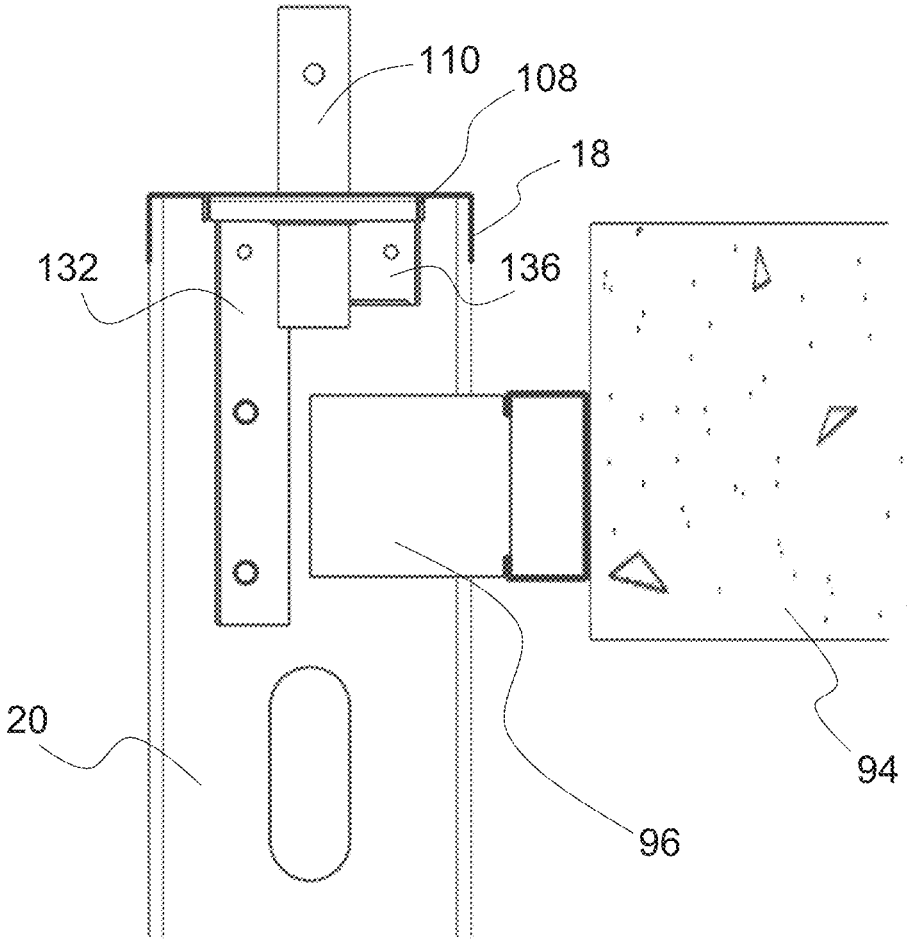
FIG. 25 is a side view of the alignment assembly shown in FIG. 24 shown attached to the top of the frame of a panel and shown attached to a curtain wall support.

Referring to FIG. 25, the saddle 130 is the same as that described above but it is attached to lower fixing plate. As shown herein the end arm 132 is generally L-shaped so that it does not interfere with curtain wall support 96 which is attached to the floor 94.

Figure 26:
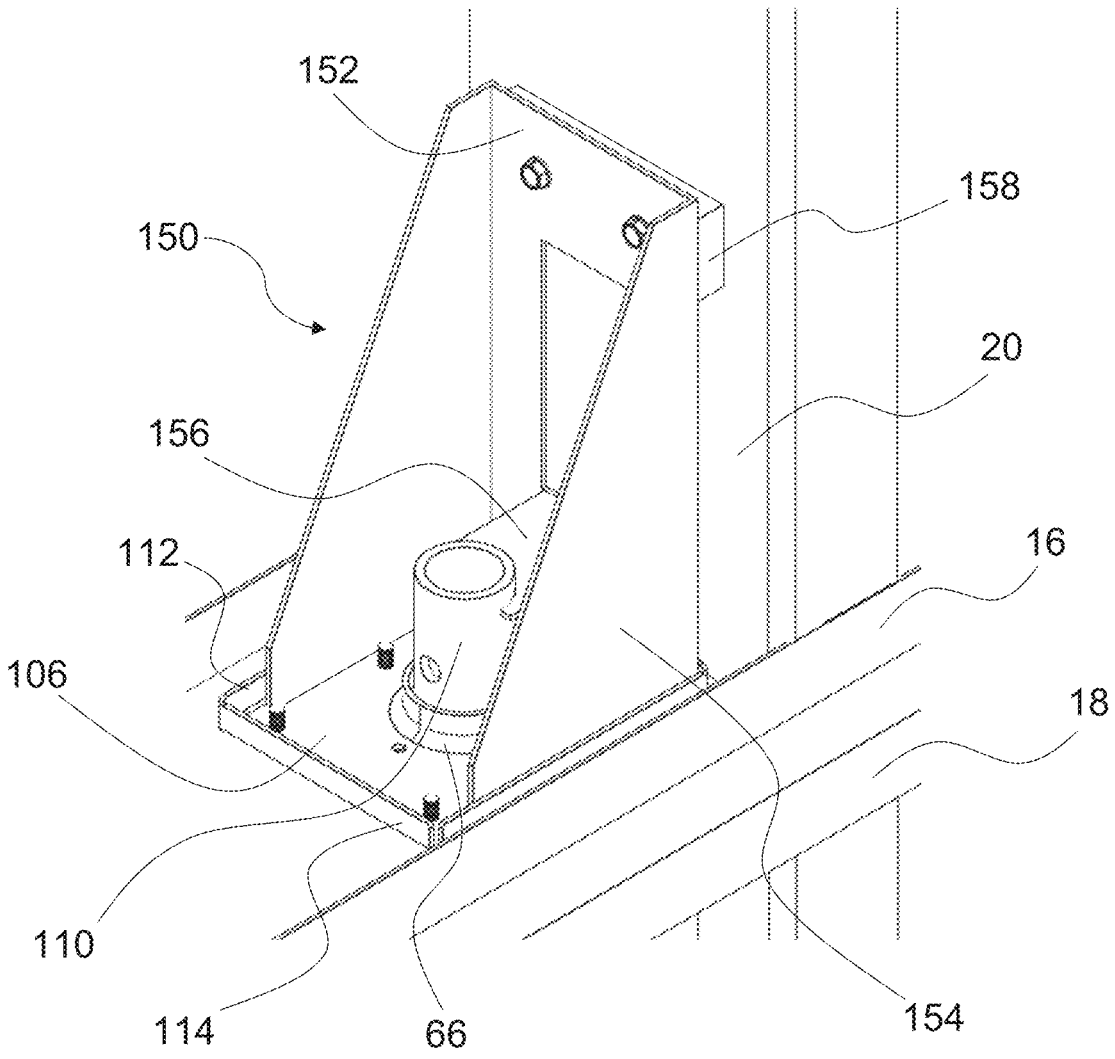
FIG. 26 is a perspective view of the alignment assembly in situ similar to that shown in FIG. 24 but showing an alternate pin saddle.

Referring to FIG. 26, another example of a pin saddle is shown generally at 150. Pin saddle 150 is similar to pin saddle 130 but the end arm 152 extends the full width of the upper alignment plate 106 and the opposed side arms 154 are both generally rectangular in shape. The alignment pin stability plate 156 extends outwardly from the end arm 152. A shim 158 may be used between the end arm 152 and the vertical member 20.

Figure 27:
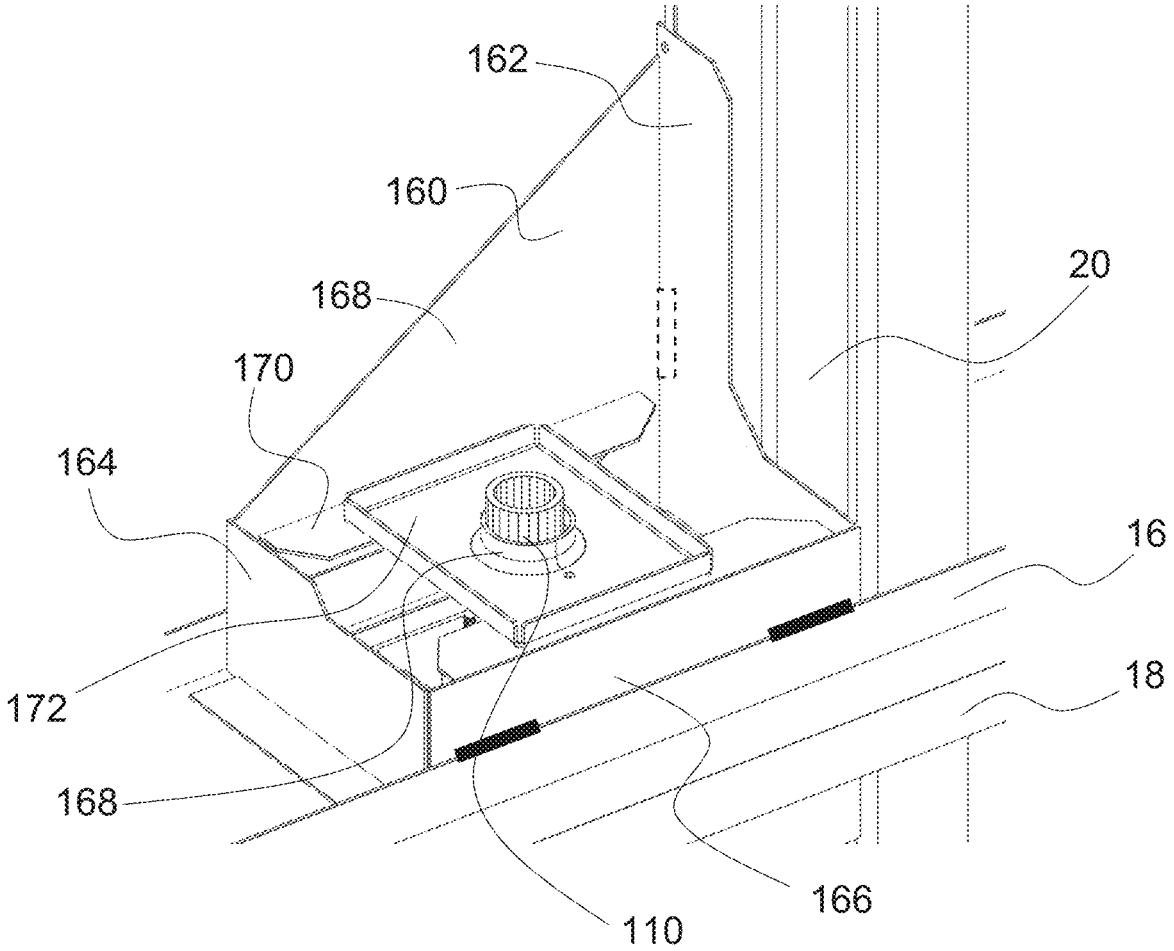
FIG. 27 is a perspective view of the alignment assembly in situ similar to that shown in FIG. 24 but including a stiffener box.
Figure 28:
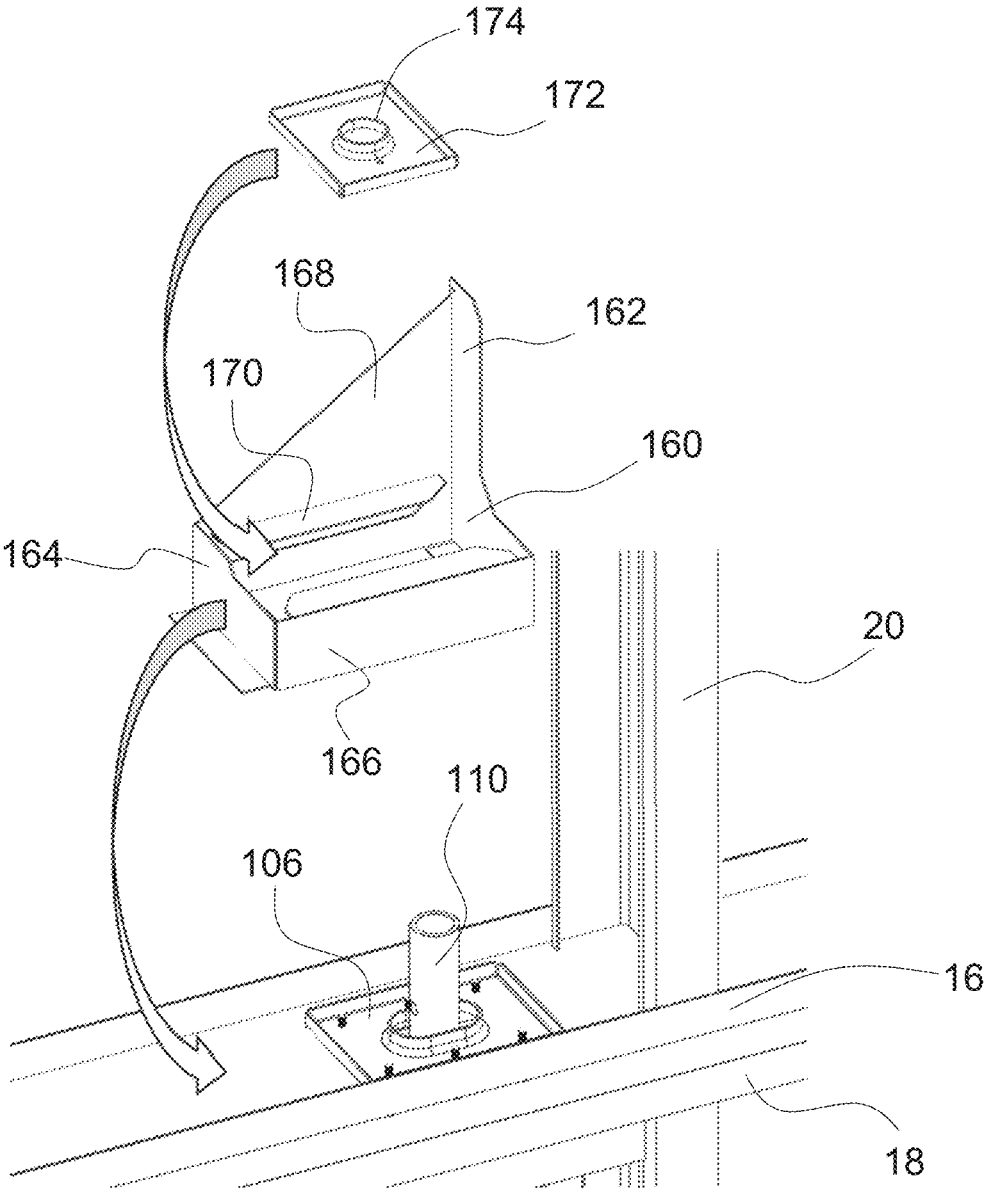
FIG. 28 is a blown apart perspective view of the alignment assembly of FIG. 27.

Referring to FIGS. 27 and 28, another example of a pin saddle is shown generally at 160. The pin saddle 160 is similar to those shown above but it is a box. Pin saddle 160 includes a member box end 162, spaced from an opposed box end 164, an inner box side 166 and an outer box side 168. Member box end 162 is generally L-shaped, outer box side 168 is generally triangular in shape, inner box side 166 is generally rectangular and opposed box end 164 is generally rectangular. An opposed pair of side shelves 170 extend inwardly from the inner box side 166 and outer box side 168. A box upper alignment plate 172 having a rim portion 174 is on the side shelves 170. Box upper alignment plate 172 is similar to upper alignment plate 106 but attached to the side shelves 170. Pin saddle 160 acts as a stiffener box and preferably is welded to bottom track 16 and vertical member 20.

Figure 29:
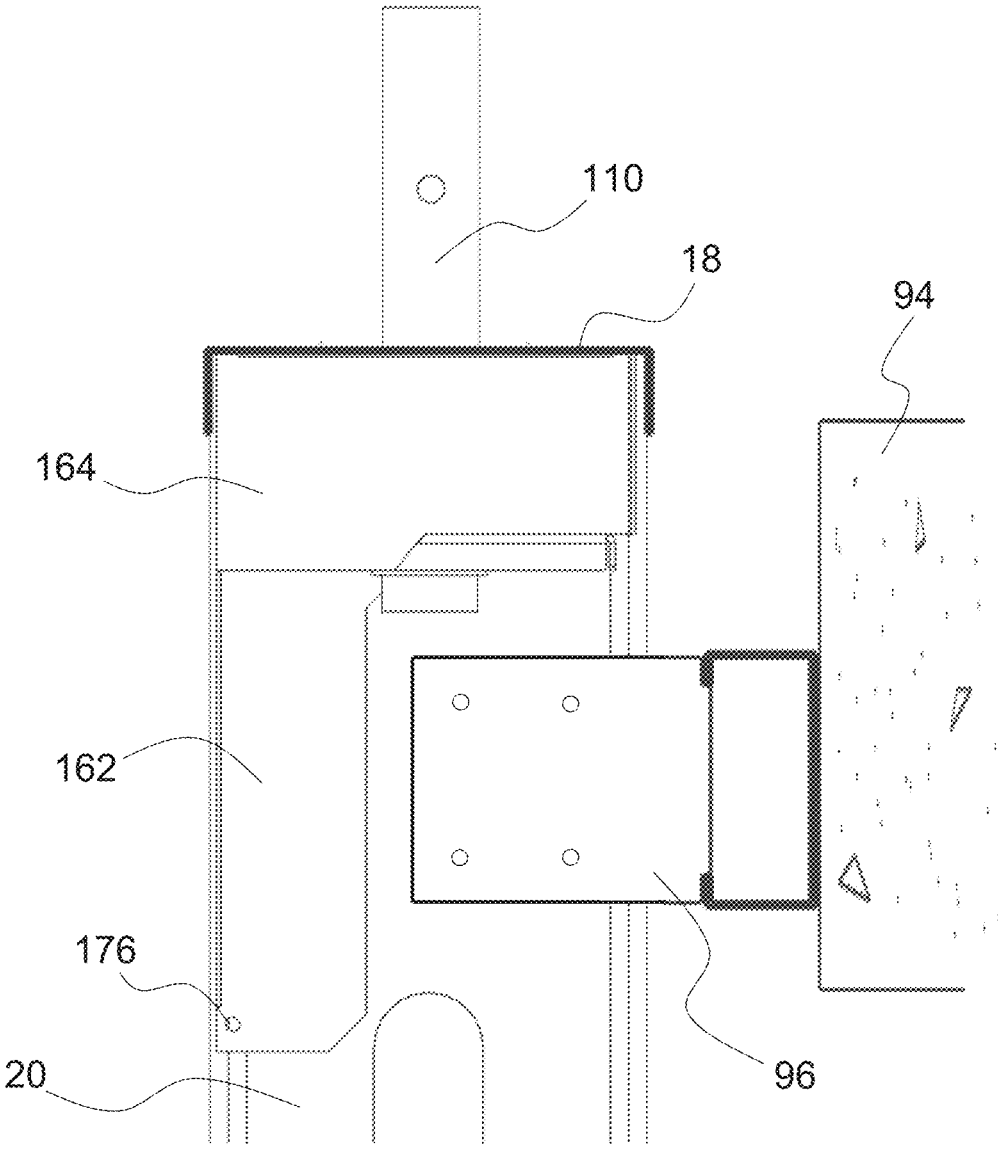
FIG. 29 is a side view of the alignment assembly shown in FIGS. 27 and 28 shown attached to the top of the frame of a panel and shown attached to a curtain wall support.

FIG. 29 shows the same pin saddle 160 but attached to the top track 18 and positioned over a lower fixing plate 108. An alignment screw 176 may be used to align pin saddle 160 while welding it in place. As can be seen in FIG. 29 member box end is generally L-shaped so that it does not interfere with curtain wall support 96 which is attached to the floor 94.

Figure 30:
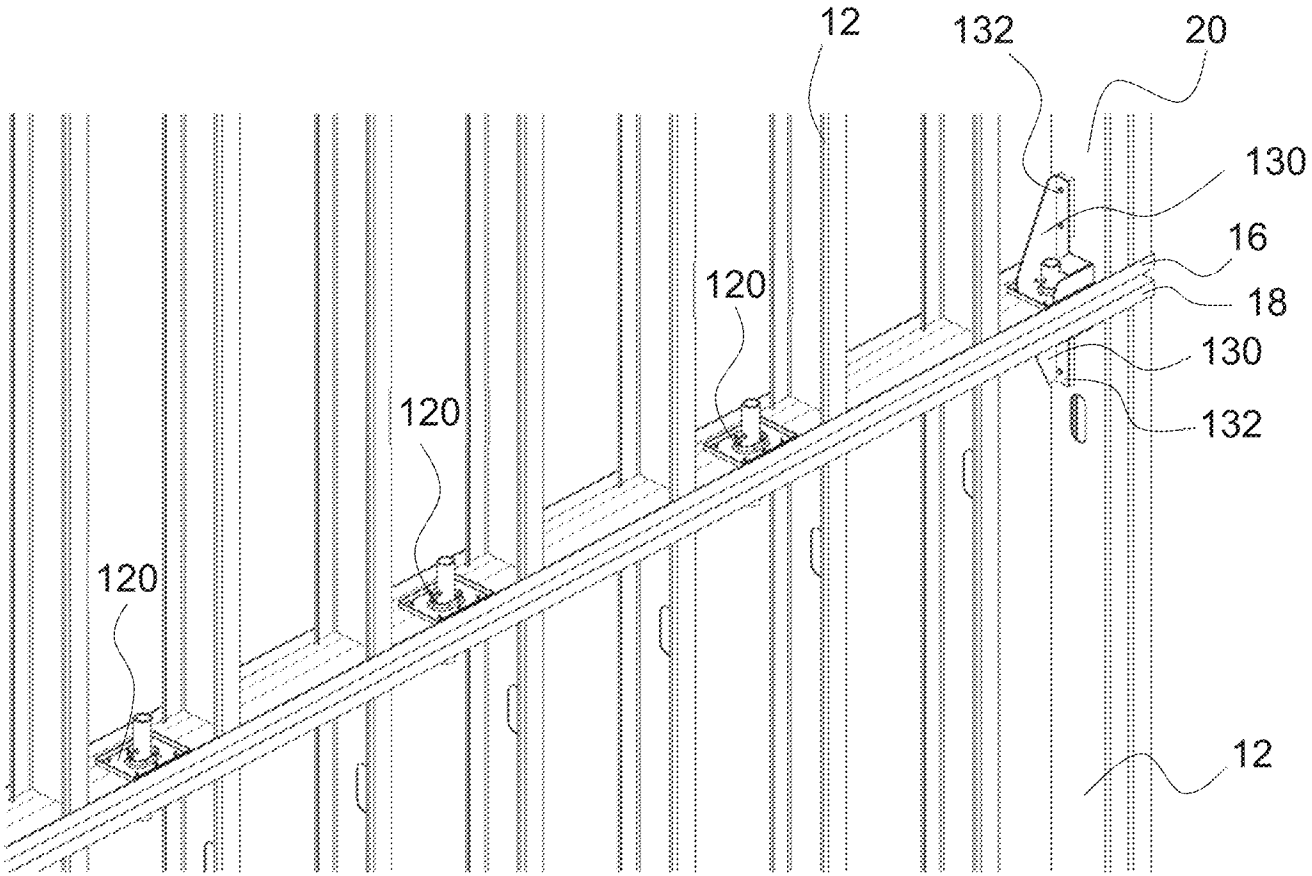
FIG. 30 is a perspective view of the alignment assembly in situ showing an example of the placements of the alignment assemblies in the frame of the panels.
Figure 31:
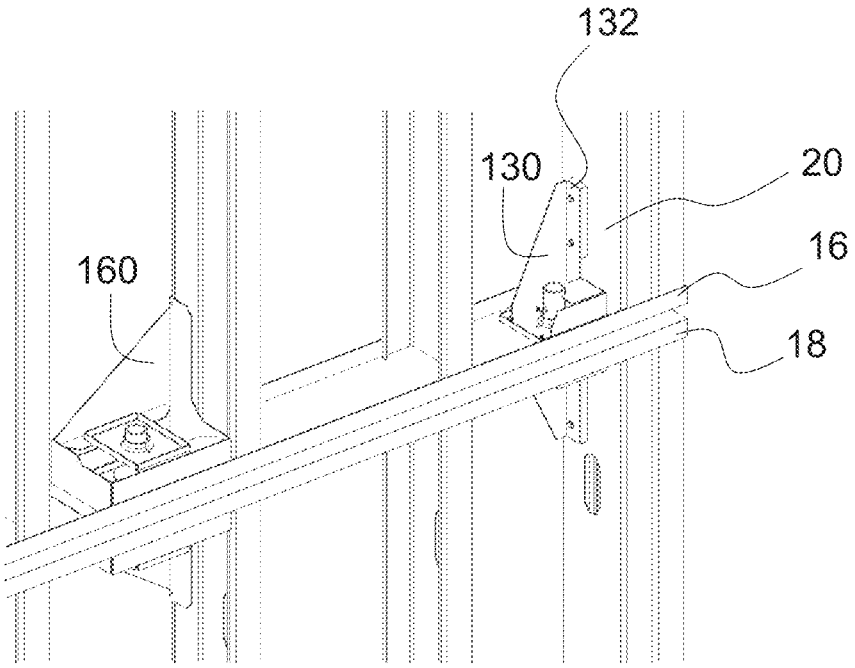
FIG. 31 is a perspective view of the alignment assembly in situ showing an alternate example of the placements of the alignment assemblies in the frame of the panels as viewed from the top.
Figure 32:
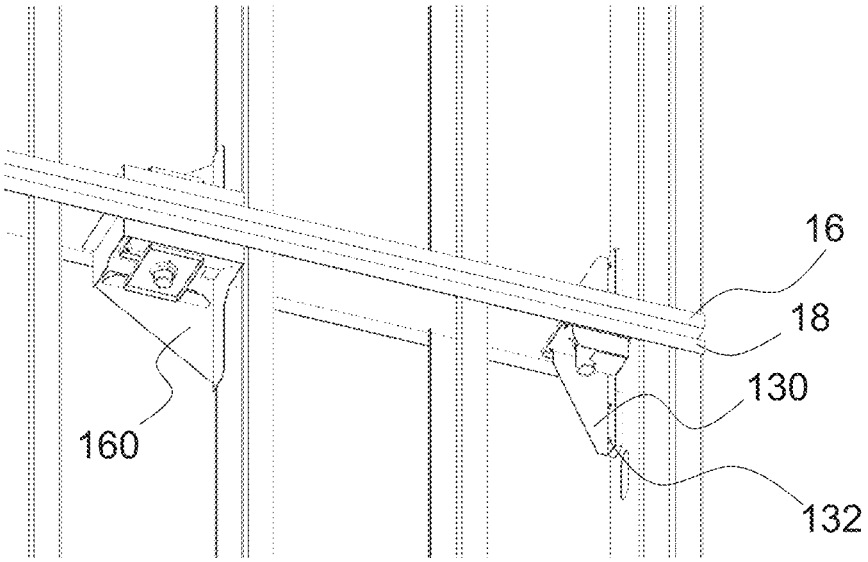
FIG. 32 is a perspective view of the alignment assembly in situ showing the example of FIG. 31 but as viewed from the bottom.

Examples of use of the pin saddles is shown in FIGS. 30 to 32. In FIG. 30 a pair of pin saddles 130 are attached to alignment assembly 104 (hidden) at the end of frames 12 such that end arms 132 of pin saddle 130 are attached to vertical member 20. A plurality of spaced apart alignment assemblies 120 are attached to bottom track 16 and top track 18. This arrangement helps reinforce the track during lifting.

In FIGS. 31 and 32 a plurality of spaced apart pin saddles are attached to bottom track 16 and top track 18. In the example shown herein a pair of pin saddles 130 are attached to alignment assembly 104 (hidden) at the end of frames 12 such that end arms 132 of pin saddle 130 are attached to vertical member 20. In addition, pin saddle 160 which acts as a stiffener box is attached around other alignment assemblies. The embodiment shown herein pin saddle 130 and stiffener box pin saddle 160 reinforce the bottom track 16 and top track 18 for lifting and for high wind conditions. The number of pin saddles 130 or 150 and stiffener box pin saddles 160 may vary depending on the wind load.

Generally speaking, the systems described herein are directed to cold formed steel (CFS) panels and alignment assembly therefore. Various embodiments and aspects of the disclosure are described in the detailed description. The description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure.

As used herein, the terms, "comprises" and "comprising" are to be construed as being inclusive and open ended, and not exclusive. Specifically, when used in the specification and claims, the terms, "comprises" and "comprising" and variations thereof mean the specified features, steps or components are included. These terms are not to be interpreted to exclude the presence of other features, steps or components.

What is claimed is:

1. A panel system configured to be attached to vertically adjacent panel systems comprising;

a frame having a top track, a bottom track and a plurality of vertical members extending between the top track and the bottom track;

at least one exterior finish component operably attached to the frame;

a plurality of alignment assemblies operably attached to the frame, each alignment assembly having;

a lower fixing plate having an alignment pin extending upwardly therefrom, the lower fixing plate being operably attached to the top track of the frame;

an upper alignment plate being operably attached to bottom track of the frame, the upper alignment plate having a hole formed therein for receiving the alignment pin;

wherein the alignment pin of the lower fixing plate is configured to be received by an upper alignment plate attached to a vertically adjacent panel system: and wherein one hole in the upper alignment plate of one of the plurality of alignment assemblies has a round hole and wherein other upper alignment plates of the plurality of alignment assemblies have ovoid holes.

2. The panel system of claim 1 wherein at least two of the alignment pins in the plurality of alignment assemblies each have a hole therein and wherein the hole is configured to receive a rigging that is attachable to a hoist.

3. The panel system of claim 1 wherein each of the round hole and the ovoid holes in the upper alignment plates of the plurality of alignment assemblies have a rim portion extending upwardly therefrom.

4. The panel system of claim 1 further including a plurality of panel systems.

5. The panel system of claim 1 wherein the lower fixing plate further includes opposing side lower lips and opposing end lower lips extending downwardly from edges thereof.

6. The panel system of claim 5 wherein the upper alignment plate further includes opposing side upper lips and opposing end upper lips extending upwardly from edges thereof.

7. The panel system of claim 1 wherein the alignment pin in each alignment assembly includes a conical cap.

8. The panel system of claim 7 wherein the conical cap is a removable conical cap.

9. The panel system of claim 1 wherein the lower fixing plate includes a flange extending downwardly from one side thereof configured to be attachable to a flange of the top track.

10. The panel system of claim 9 wherein the flange of the lower fixing plate is attached to the flange of the top track with screws.

11. The panel system of claim 10 further including an angle tab attachable to the lower fixing plate.

12. The panel system of claim 11 wherein the lower fixing plate includes two slots on either side of the alignment pin for receiving screws and the screws are for attaching the lower fixing plate to the top track of the frame of the panel.

13. The panel system of claim 1 wherein at least one of the plurality of alignment assemblies includes at least one pin saddle attached to one of the lower fixing plate and the upper alignment plate.

14. The panel system of claim 13 wherein the pin saddle includes an end arm extending vertically from one end of the lower fixing plate and the upper alignment plate and attached to one of the plurality of vertical members of the frame.

15. The panel system of claim 14 wherein the pin saddle further includes at least one side arm extending vertically from one side of one of the lower fixing plate and the upper alignment plate.

16. The panel system of claim 15 wherein the pin saddle includes two opposed side arms extending vertically from each side of one of the lower fixing plate and the upper alignment plate.

17. The panel system of claim 16 wherein the pin saddle further includes a second end arm spaced from the end arm and extending vertically from one end of the lower fixing plate and the upper alignment plate and whereby the end arm, the second end arm and the two opposed side arms form a box.

18. The panel system of claim 16 wherein the pin saddle further includes an alignment pin stability plate having a cut out portion for receiving the alignment pin.

19. The panel system of claim 17 wherein the pin saddle further includes an upper fixing plate having a hole formed therein for receiving the alignment pin.

20. The panel system of claim 7 wherein the at least one of the plurality of alignment assemblies further includes a second pin saddle and the at least one pin saddle is an upper pin saddle attached to the upper alignment plate and the second pin saddle is a lower pin saddle attached to the lower fixing plate.

21. The panel system of claim 20 wherein the plurality alignment assemblies includes a pin saddle and a second pin saddle being attached to the frame.

22. An alignment assembly for use with panels having a frame having a top track, a bottom track and a plurality of vertical members extending between the top track and the bottom track and at least one exterior finish component operably attached to the frame, the alignment assembly comprising:

a lower fixing plate having an alignment pin extending upwardly therefrom; the lower fixing plate being operably attached to the top track of the frame;

an upper alignment plate being operably attached to bottom track of the frame, the upper alignment plate having a hole formed therein for receiving the alignment pin;

wherein the alignment pin of the lower fixing plate is configured to be received by an upper alignment plate attached to a vertically adjacent panel: and wherein one hole in the upper alignment plate of one of the plurality of alignment assemblies has a round hole, and wherein other upper alignment plates of the plurality of alignment assemblies have ovoid holes.

23. The alignment assembly of claim 22 wherein each of the round hole and the ovoid holes in the upper alignment plate have a rim portion extending upwardly therefrom.

24. The alignment assembly of claim 22 wherein the alignment pin has a hole therein and wherein the hole is configured to receive a rigging that is attachable to a hoist.

25. The alignment assembly of claim 24 wherein the alignment pin includes a conical cap.

26. The alignment assembly of claim 25 wherein the conical cap is a removable conical cap.

27. The alignment assembly of claim 22 wherein the lower fixing plate further includes opposing side lower lips and opposing end lower lips extending downwardly from edges thereof.

28. The alignment assembly of claim 27 wherein the upper alignment plate further includes opposing side upper lips and opposing end upper lips extending upwardly from edges thereof.

29. The alignment assembly of claim 22 further including at least one pin saddle attached to one of the lower fixing plate and the upper alignment plate.

30. The alignment assembly of claim 29 wherein the pin saddle includes an end arm extending vertically from one end of the lower fixing plate and the upper alignment plate and attachable to one of the plurality of vertical members of the frame.

31. The alignment assembly of claim 30 wherein the pin saddle further includes at least one side arm extending vertically from one side of one of the lower fixing plate and the upper alignment plate.

32. The alignment assembly of claim 31 wherein the pin saddle includes two opposed side arms extending vertically from each side of one of the lower fixing plate and the upper alignment plate.

33. The alignment assembly of claim 32 wherein the pin saddle further includes a second end arm spaced from the end arm and extending vertically from one end of the lower fixing plate and the upper alignment plate and whereby the end arm, the second end arm and the two opposed side arms form a box.

34. The alignment assembly of claim 31 wherein the pin saddle further includes an alignment pin stability plate having a cut out portion for receiving the alignment pin.

35. The alignment assembly of claim 33 wherein the pin saddle further includes an upper fixing plate having a hole formed therein for receiving the alignment pin.

36. The alignment assembly of claim 29 further includes a second pin saddle and the at least one pin saddle is an upper pin saddle attached to the upper alignment plate and the second pin saddle is a lower pin saddle attached to the lower fixing plate.

37. The alignment assembly of claim 24 wherein the lower fixing plate includes a flange extending downwardly from one side thereof configured to be attachable to a flange of the top track.

38. The alignment assembly of claim 37 wherein the flange of the lower fixing plate is attached to the flange of the top track with screws.

39. The alignment assembly of claim 38 further including an angle tab attachable to the lower fixing plate.

40. The alignment assembly of claim 39 wherein the lower fixing plate includes two slots on either side of the alignment pin for receiving screws and the screws are for attaching the lower fixing plate to the top track of the frame of the panel.

* * * * *